US012553682B2

(12) United States Patent
Walthert

(10) Patent No.: US 12,553,682 B2
(45) Date of Patent: Feb. 17, 2026

(54) ARCHERY CAM ADJUSTER AND ASSOCIATED METHOD

(71) Applicant: Innovative Design Management LLC, North Chili, NY (US)

(72) Inventor: Hans Jakob Walthert, Leroy, NY (US)

(73) Assignee: INNOVATIVE DESIGN MANAGEMENT LLC, North Chili, NY (US)

( * ) Notice: Subject to any disclaimer, the term of this patent is extended or adjusted under 35 U.S.C. 154(b) by 0 days.

(21) Appl. No.: 18/865,472

(22) PCT Filed: Feb. 23, 2024

(86) PCT No.: PCT/US2024/017012
§ 371 (c)(1),
(2) Date: Nov. 13, 2024

(87) PCT Pub. No.: WO2024/178290
PCT Pub. Date: Aug. 29, 2024

(65) Prior Publication Data

US 2025/0369719 A1 Dec. 4, 2025

Related U.S. Application Data

(60) Provisional application No. 63/448,114, filed on Feb. 24, 2023.

(51) Int. Cl.
*F41B 5/14* (2006.01)
*F41B 5/10* (2006.01)

(52) U.S. Cl.
CPC ..... *F41B 5/105* (2013.01); *F41B 5/14* (2013.01); *F41B 5/1403* (2013.01)

(58) Field of Classification Search
CPC ..... F41B 5/105; F41B 5/1403; F41B 5/14; F41B 5/123
(Continued)

(56) References Cited

U.S. PATENT DOCUMENTS 4,458,657 A 7/1984 Stockmar
9,115,953 B1 * 8/2015 Huang ..... F41B 5/105
(Continued)

OTHER PUBLICATIONS

The International Bureau of WIPO; International Preliminary Report on Patentability; Dated Aug. 15, 2025; 6 pages.
(Continued)

*Primary Examiner* — John E Simms, Jr.
(74) *Attorney, Agent, or Firm* — Barclay Damon LLP

(57) ABSTRACT

An archery cam adjustment assembly for an archery bow includes an axle extending along an axis from a first end to an opposing second end and structured to traverse a limb of an archery bow. The axle further includes a central portion defining a plurality of threads. A cam support is structured to support a cam and to engage the central portion of the axle. A securing member is structured to be moved between a locked and an unlocked state. In the unlocked state, the axle is enabled to rotate freely relative to the cam support to move the cam support along the axis and displace the cam in a lateral direction with respect to the limb. In the locked state, the axle is inhibited from rotating relative to the cam support and the cam support is inhibited from moving along the axis.

20 Claims, 24 Drawing Sheets

(58) Field of Classification Search
USPC ..... 124/86
See application file for complete search history.

(56) References Cited

U.S. PATENT DOCUMENTS

| | | | | |
|---|---|---|---|---|
| 9,528,788 | B2 * | 12/2016 | McPherson | F41B 5/14 |
| 9,683,806 | B1 * | 6/2017 | Yehle | F41B 5/105 |
| 10,126,087 | B1 * | 11/2018 | Grace | F41B 5/123 |
| 11,536,532 | B1 * | 12/2022 | Grace | F41B 5/1403 |
| 12,130,112 | B1 * | 10/2024 | Hayes | F41B 5/1403 |
| 2020/0158461 | A1 * | 5/2020 | Romero | F41B 5/105 |
| 2023/0113520 | A1 * | 4/2023 | Grace | F41B 5/1403<br>124/25.6 |
| 2023/0358501 | A1 * | 11/2023 | Hansen | F41B 5/1403 |

OTHER PUBLICATIONS

The International Searching Authority; International Search Report and Written Opinion; International Application No. PCT/US2024/017012; Dated: Jun. 17, 2024; 8 pages.

* cited by examiner

ARCHERY CAM ADJUSTER AND ASSOCIATED METHOD

CROSS-REFERENCE TO RELATED APPLICATION

This application is a national stage application filed pursuant to 35 U.S.C. § 371 of International Application No.: PCT/US2024/017012, which was filed on Feb. 23, 2024 and claims the benefit and priority of U.S. Provisional Patent Application No. 63/448,114, entitled Archery Cam Adjuster and Associated Method, filed on Feb. 24, 2023, under relevant portions of 35 U.S.C. § 119 and 35 U.S.C. § 120. The entire contents of said application are hereby incorporated by reference.

BACKGROUND

Most archery bows are capable of being tuned by their user to customize the archery bow to the user's shooting tendencies. One of the ways that an archery bow is tuned is by adjusting the position of the cam relative to the limb or limb assembly. In order to accomplish this type of tuning, a bow press must be used to disassemble the limb or limb assembly and cam. Once disassembled, parts may be removed or swapped out, the lateral position of the cam along its axle can be adjusted, and the cam and the limb or limb assembly can then be reinstalled onto the archery bow. Not only is this tuning procedure difficult, but it is also very time consuming and something that would be very challenging to accomplish in the field. In fact, and in many instances, this type of tuning and/or repair simply cannot be performed by the bow end user.

The foregoing background describes some, but not necessarily all, of the problems, disadvantages and shortcomings related to tuning current archery bows by adjusting the position of the cam relative to the limb assembly.

BRIEF DESCRIPTION

Therefore, and according to one aspect, there is provided an archery bow that includes a limb assembly comprising a limb portion. A cam adjustment assembly is configured to couple to the limb assembly. The cam adjustment assembly includes an axle extension extending along an axis and structured to traverse the limb portion. The axle extension includes a first end, an opposing second end, and a central portion. The central portion of the axle extension preferably includes a set of threads. The archery bow further includes a cam support structured to engage the central portion of the limb extension and move along the axis of the axle extension. A securing member is structured to partially accept the axle extension and be moved between a locked and an unlocked state. A plug is structured to rotatably engage the securing member and to engage the second end of the axle extension. A cam is supported by the cam support and structured to rotate relative to the cam support. In the unlocked state, the plug is enabled to rotate relative to the securing member and the axle extension is enabled to rotate freely relative to the cam support to move the cam support along the axis in order to displace the cam in a lateral direction with respect to the limb portion. In the locked state, the plug is inhibited from rotating relative to the securing member and the extension axle is inhibited from rotating relative to the cam support.

In an embodiment, the securing member further includes a clamp comprising a first clamp portion and a second clamp portion. In an embodiment, the first clamp portion and the second clamp portion are structured to at least partially surround the plug and, in the locked state, exert a biasing force in a direction along the axis to inhibit rotation of the plug relative to the securing member and the axle extension. In at least one embodiment, the cam support further includes a positioning member structured to engage the securing member and further including one or more position markings indicating a lateral position of the cam support. In at least another embodiment, the securing member defines an aperture, wherein the one or more position markings of the positioning member are visible through the aperture and wherein, in the locked state, the positioning member inhibits rotation of the cam support. In an embodiment, the securing member further includes a micro adjuster structured to engage the plug, wherein, in the unlocked state, the micro adjuster is structured to enable a micro adjustment of a rotational position of the plug relative to the securing member. In a further embodiment, the plug includes a plurality of positioning elements, and the micro adjuster is structured to engage one of the plurality of positioning elements to secure the plug in a corresponding rotational position. In an embodiment, the micro adjuster is structured to produce an auditory indication when the plug is secured in the corresponding rotational position.

According to another aspect of the invention, an archery cam adjustment assembly for an archery bow includes an axle extending along an axis from a first end to an opposing second end and structured to traverse a limb of an archery bow, wherein the axle further includes a central portion that is preferably threaded. A cam support is structured to support a cam and to further engage the central portion of the axle. A securing member is configured to be moved between a locked and an unlocked state. A plug is structured to rotatably engage the securing member and engage the second end of the axle. In the unlocked state, the plug is enabled to rotate relative to the securing member and the axle is enabled to rotate freely relative to the cam support to move the cam support along the axis in order to displace the cam in a lateral direction with respect to the limb. In the locked state, the plug is inhibited from rotating relative to the securing member and the axle is inhibited from rotating relative to the cam support.

According to yet another aspect of the invention, there is provided a method of manufacturing an archery cam adjustment assembly, which includes the following steps:

(a) structuring an axle extension to extend along an axis from a first end to an opposing second end and to traverse a limb of an archery bow, and to comprise a central portion, which is preferably threaded;
(b) structuring a cam support to engage the central portion of the axle extension and to support a cam of an archery bow;
(c) structuring a securing member to define a bore and be moved between a locked and an unlocked state; and
(d) structuring a plug to be at least partially accepted by the bore and to engage an end of the axle extension. In the unlocked state, the extension is enabled to rotate freely relative to the cam support to move the cam support along the axis and displace the cam in a lateral direction with respect to the limb. In the locked state, the axle extension is inhibited from rotating relative to the cam support and the cam support is inhibited from moving along the axis.

BRIEF DESCRIPTION OF THE DRAWINGS

A more particular description of the invention briefly summarized above may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. Thus, for further understanding of the nature and objects of the invention, references can be made to the following Detailed Description, which should be read in connection with the accompanying drawings.

The purpose of the drawings is to depict salient features of the present invention and associated method of manufacture and are not specifically provided to scale. Therefore, the drawings should not be relied upon for scalar purposes. In addition, and for reasons of clarity, the same element numbers may be used throughout the accompanying drawings to indicate same elements from one drawing to the next.

DETAILED DESCRIPTION

Throughout this disclosure set forth herein, the word "including" indicates or means "including, without limitation," the word "includes" indicates or means "includes, without limitation," the phrases "such as" and "e.g." indicate or mean "including, without limitation," and the phrase "for example" refers to a non-limiting example. It will be understood that the herein described versions are examples that embody certain inventive concepts, as detailed herein. To that end, other variations and modifications will be readily apparent to those of sufficient skill. In addition, certain terms are used throughout this discussion in order to provide a suitable frame of reference with regard to the accompanying drawings. These terms such as "upper", "lower", "forward", "rearward", "interior", "exterior", "front", "back", "top", "bottom", "inner", "outer", "first", "second", and the like are not intended to limit these concepts, except where so specifically indicated. For purposes of the following discussion, the terms "about", "generally", or "approximately" as used herein may refer to a range of 80%-125% of the claimed or disclosed value.

Figure 1:
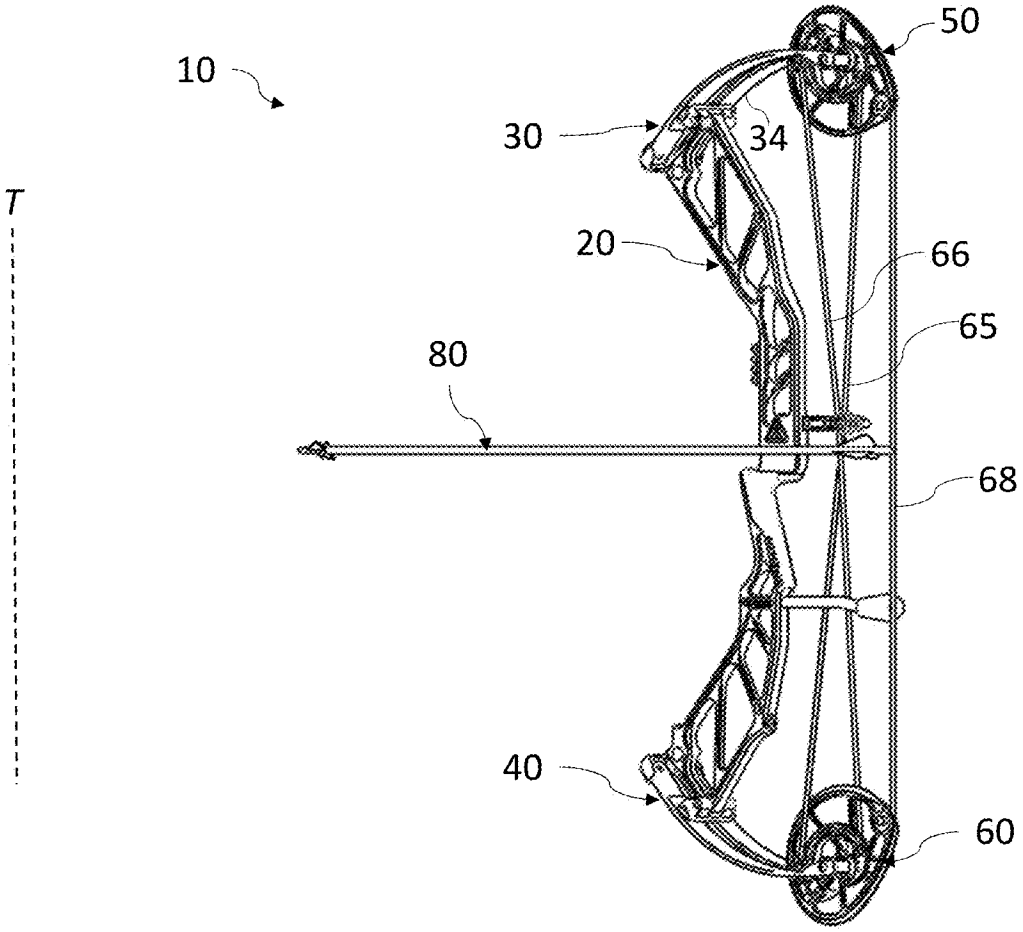
FIG. 1 illustrates a side perspective view of a compound bow loaded with a projectile and aimed at a target in accordance with aspects of the present invention.

As illustrated in FIG. 1, an example of an archery bow 10 is shown having a body 20, a first limb assembly 30 at a first end of the body 20 and a second limb assembly 40 at a second end of the body 20 opposite the first end. The first limb assembly 30 supports a first rotor or cam 50 and the second limb assembly 40 supports a second rotor or cam 60. The first and second cams 50, 60 are operatively coupled to each other using a plurality of power cords 65,66. A bow string 68 extends between the first and second cams 50, 60 and moves along a bowstring plane in order to propel a projectile, e.g., an arrow 80, towards a target T.

Figure 6:
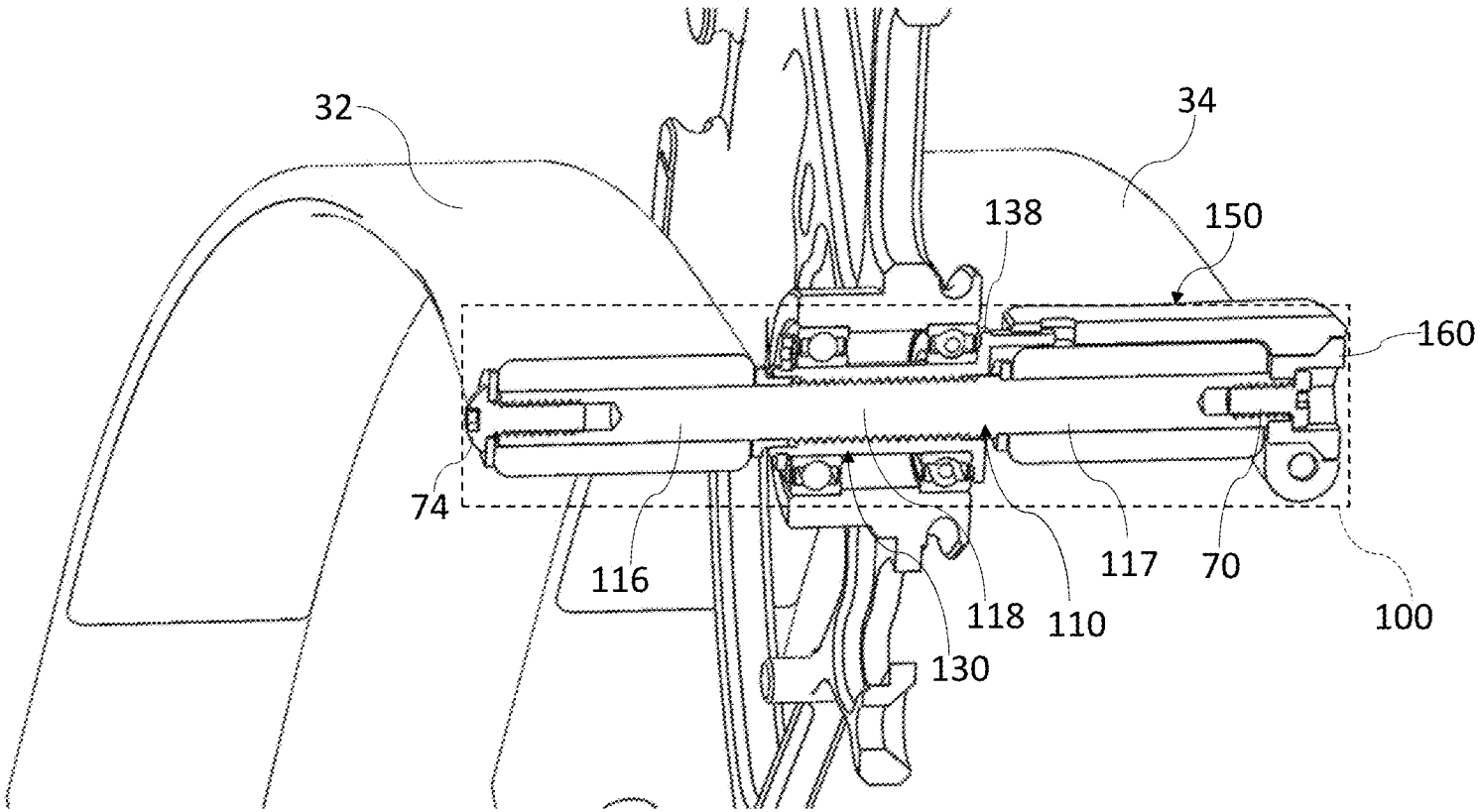
FIG. 6 illustrates a vertical sectional view of the cam, the cam adjuster, and the limb assembly of FIG. 2 taken along line A-A.

Referring generally to FIG. 6, a cam adjustment assembly 100 is installed onto the limb assembly 40. The cam adjustment assembly 100 according to this exemplary embodiment generally includes an axle or axle extension 110, at least one cam carrier 130, a securing member 150, and a plug 160 configured to engage the securing member 150 and the axle extension 110.

Figure 2:
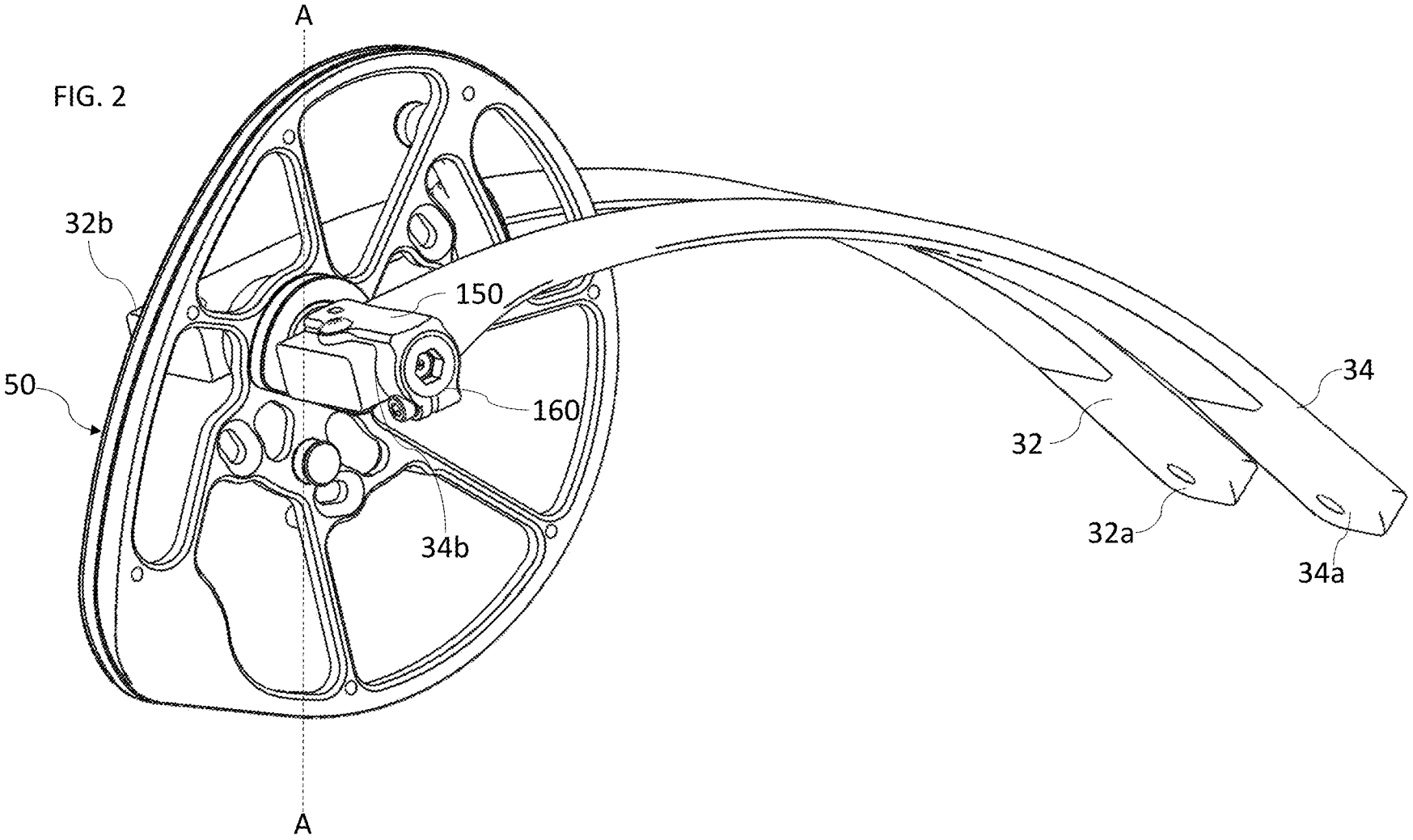
FIG. 2 illustrates a perspective view of a limb assembly including a cam from the embodiment of FIG. 1.
Figure 3:
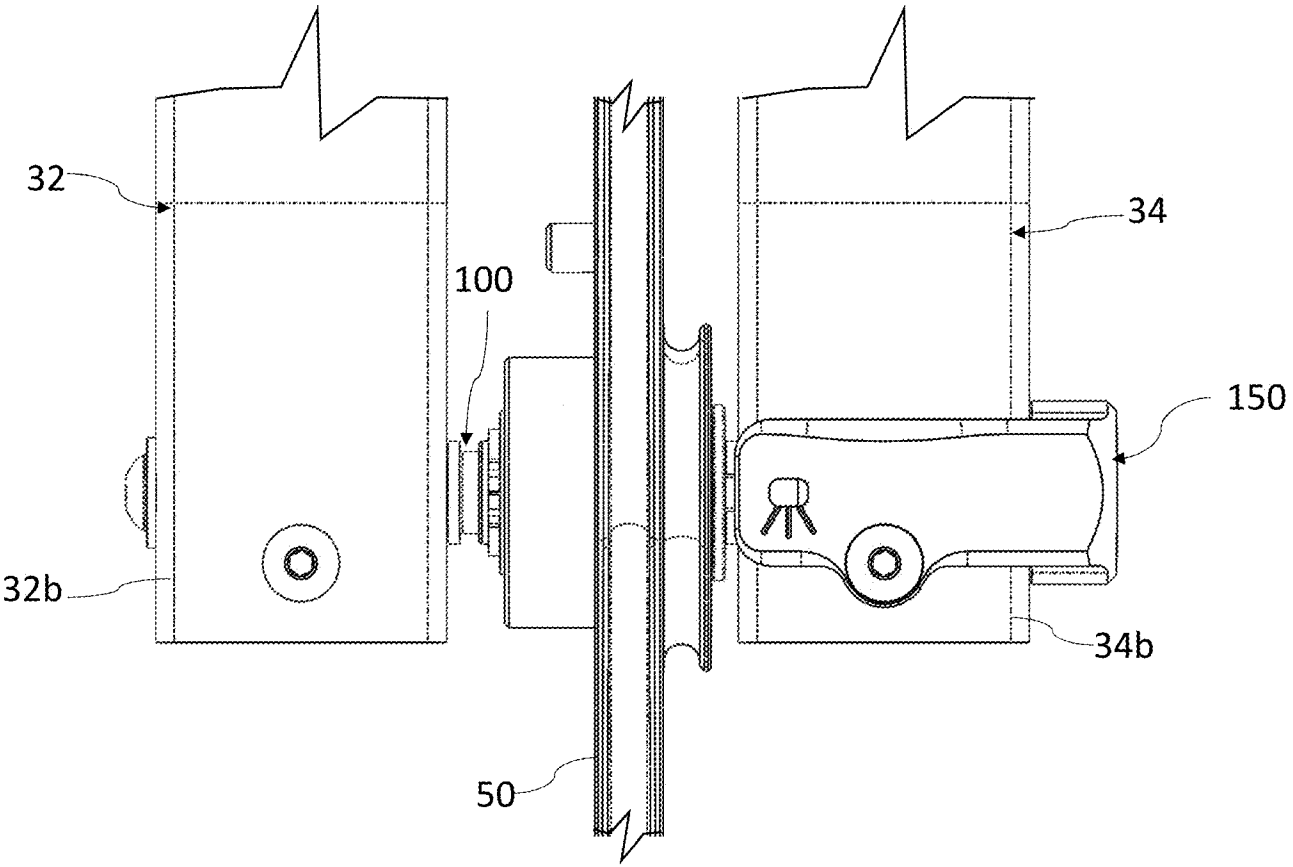
FIG. 3 illustrates a top perspective view of a portion of the limb assembly and cam of FIG. 2, showing the cam as coupled to the limb assembly.
Figure 4:
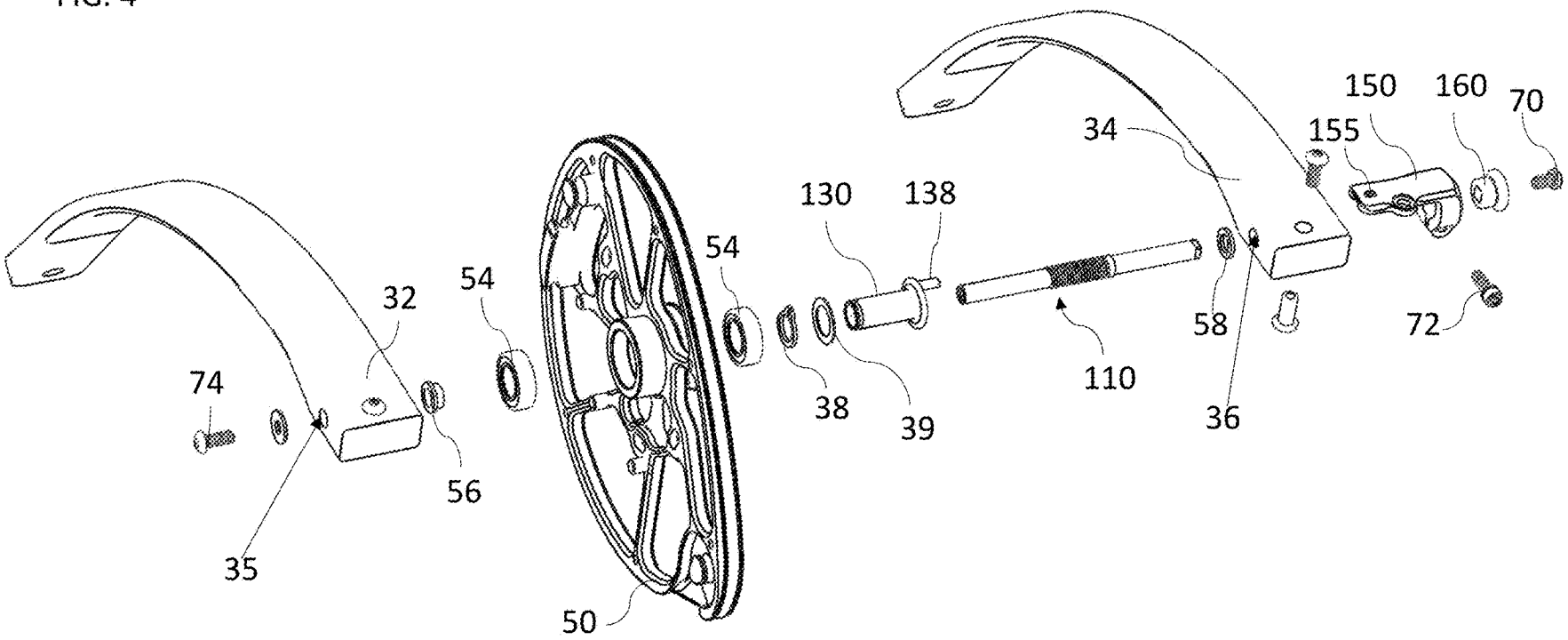
FIG. 4 illustrates an exploded assembly view of the limb assembly and cam of FIG. 2.
Figure 5:
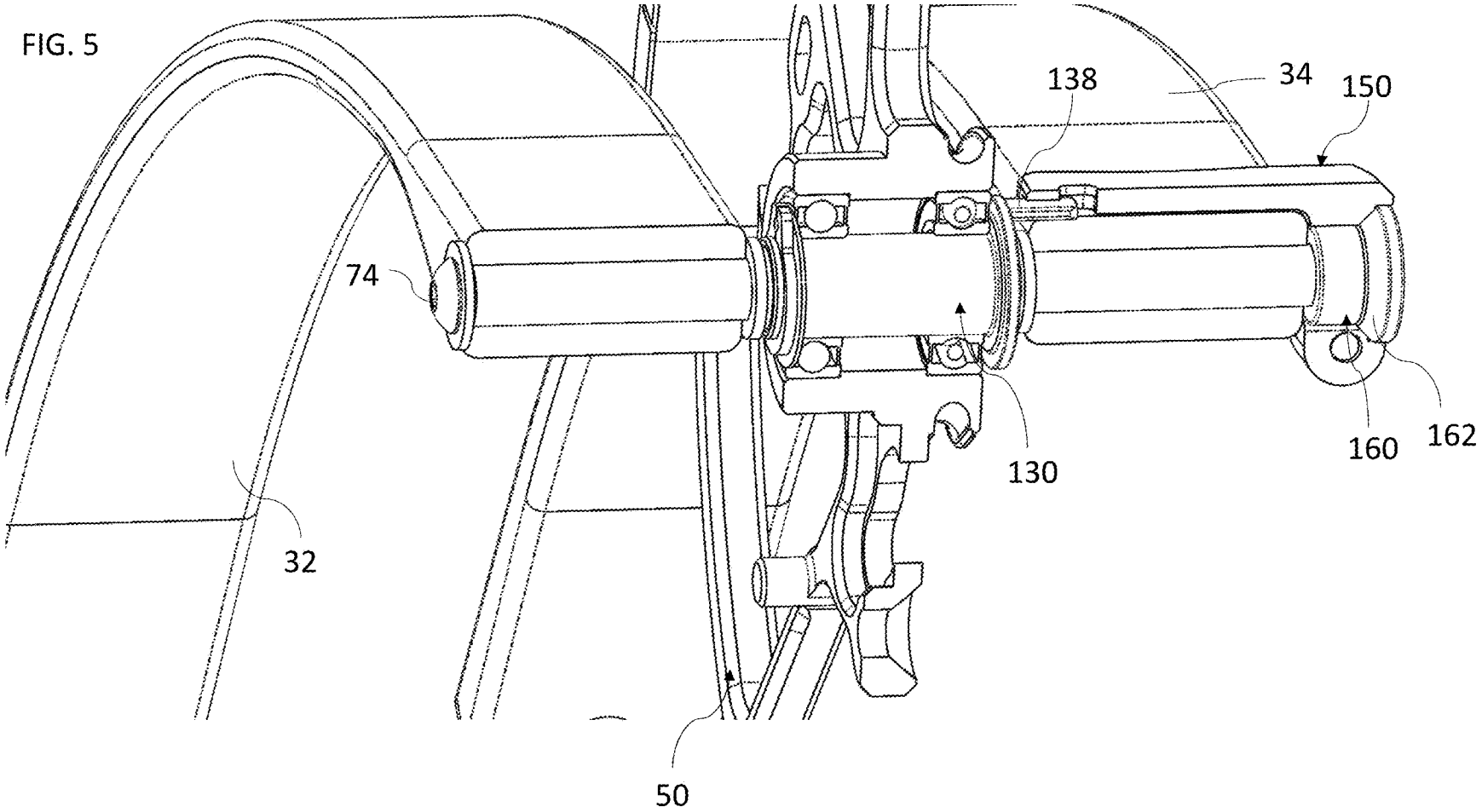
FIG. 5 illustrates a vertical sectional view of the cam of FIG. 2, as taken along line A-A.

For ease in description, the inventive concepts will be herein explained with particular reference to the first limb assembly 30 and the first cam 50. It will be understood that the second limb assembly 40 and the second cam 60 may comprise similar components and operate in a similar manner. Referring generally to FIGS. 2-4, the first limb assembly 30 includes a first limb assembly portion 32 and a second limb assembly portion 34, the latter also being shown in FIG. 1. The first limb assembly portion 32 includes a first end 32*a* that is coupled to the body 20 of the archery bow 10 and an opposing second end 32*b*. Similarly, the second limb assembly portion 34 includes a first end 34*a* that is coupled to the body 20 of the archery bow 10 and an opposing second end 34*b*. The second ends 32*b*, 34*b* of the first and second limb assembly portions 32, 34 are structured to support the cam adjustment assembly 100, which in turn supports the first cam 50 with the first cam 50 being situated between the second ends 32*b*, 34*b* of the first and second limb assembly portions 32, 34, respectively, as further discussed below. Each of the first and second limb assembly portions 32, 34 according to this embodiment are defined by a curvilinear shape.

Figure 9:
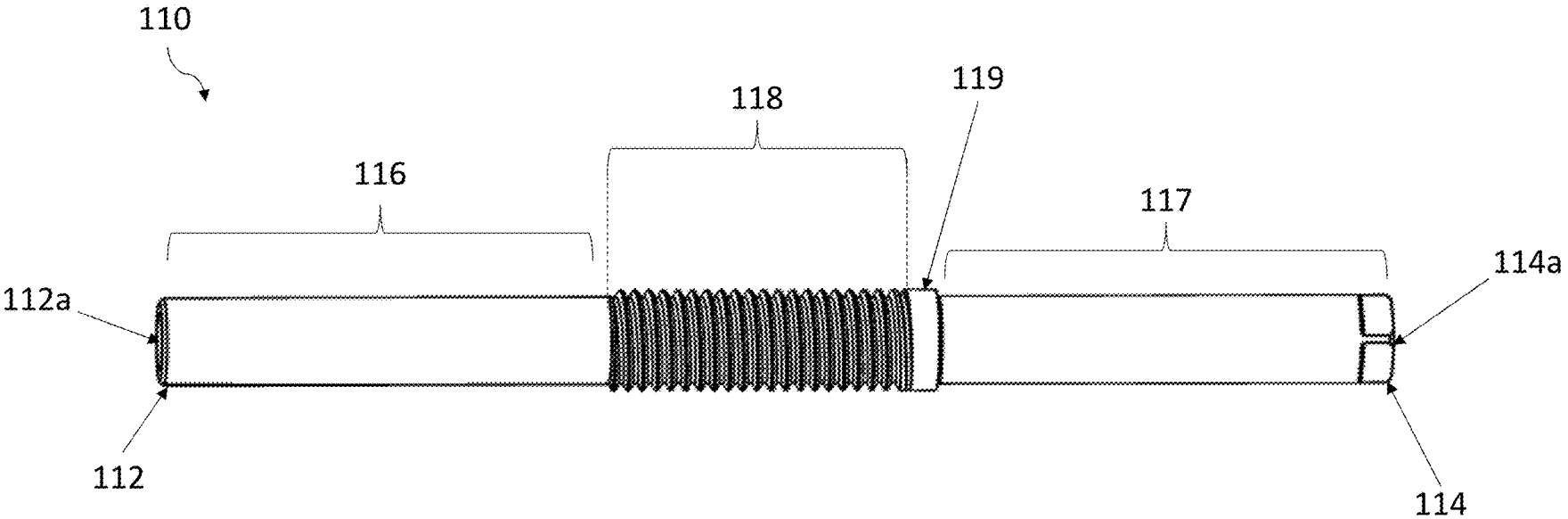
FIG. 9 illustrates a perspective view of an exemplary embodiment of an axial extension of the cam adjuster in accordance with aspects of the present invention.

Details relating to an axle extension 110 are shown in FIG. 9, with the axle extension being shown in phantom lines in FIG. 6. With reference to FIG. 9, the axle extension 110 extends between a first end 112 and a second end 114. The first end 112 and the second end 114 each define a cavity 112*a*, 114*a*, that is further defined, according to this embodiment, by a threaded inner wall. The axial extension 110, which according to this embodiment, is a single component is further defined by respective first and second end portions 116, 117, and a central or intermediate portion 118 disposed between the first and second end portions 116, 117. An outer surface of the central portion 118 of the axial extension 110 includes a set of external threads, while the first and second end portions 116, 117 are not threaded. Still referring to FIG. 9, a shoulder 119 is positioned between the central portion 118 and the second end portion 117. The shoulder 119 may be formed as a single unit with the axial extension 110 or may be a separate component that is fixedly coupled to the axial extension 110. In an embodiment, at least one of the first end portion 116, the second end portion 117, and the central portion 118 has a diameter that is of a different size than the remaining portions.

Figure 10:
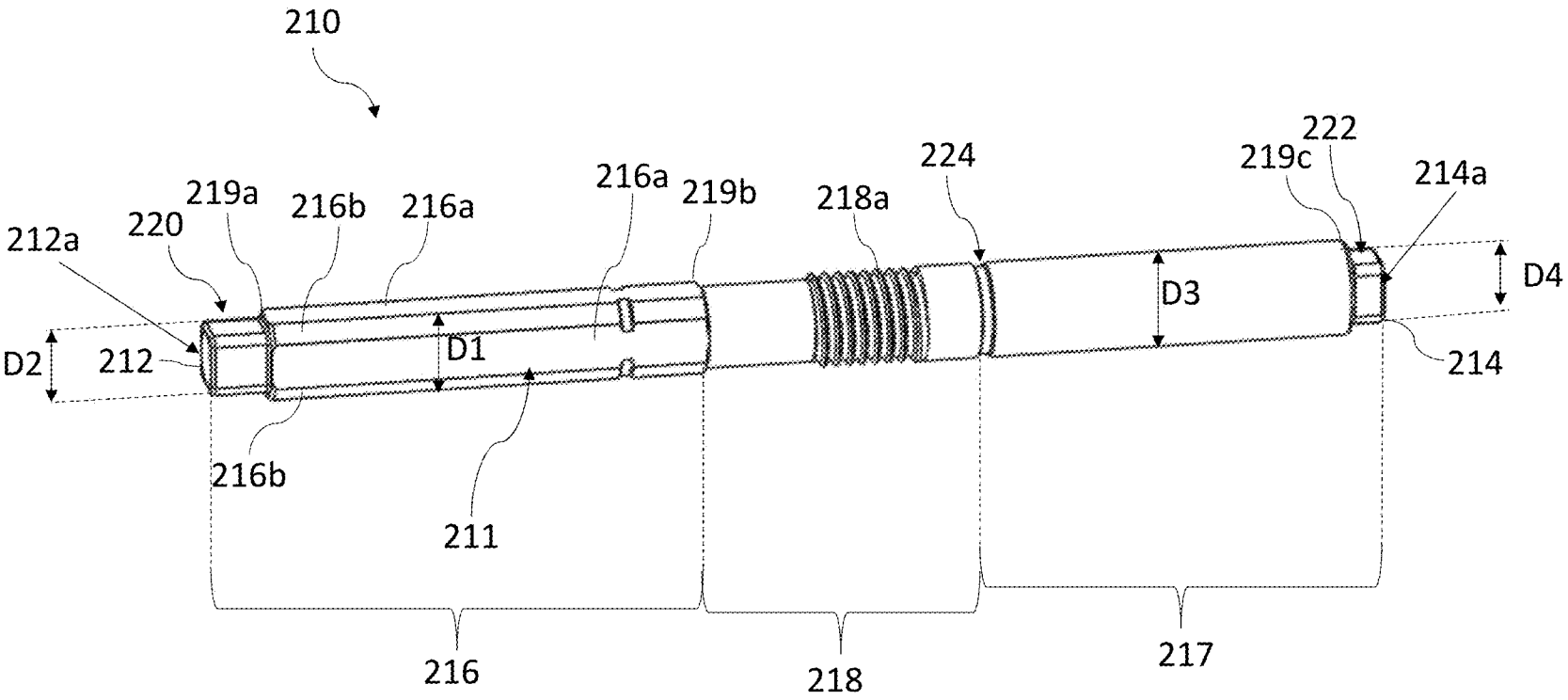
FIG. 10 illustrates a perspective view of another exemplary embodiment of an axial extension of the cam adjuster in accordance with aspects of the present invention.

Referring specifically to FIG. 10, another embodiment of the axial extension 210 is shown. The axle extension 210 extends between a first end 212 and a second end 214. The first end 212 and the second end 214 each define a cavity 212*a*, 214*a*, that is further defined, according to this embodiment, by a threaded inner wall. As shown, the axial extension 210 is a single component and is further defined by respective first and second end portions 216, 217, and a central or intermediate portion 218 disposed between the first and second end portions 216, 217. An outer surface of the central portion 218 of the axial extension 210 includes a set of external threads 218*a*, while the first and second end portions 216, 217 are not threaded.

Still referring to FIG. 10, the first end portion 216 includes a plurality of first and second surfaces 216*a*, 216*b* positioned around a circumference of the first end portion 216 and defining an exterior 211. In the embodiment shown, the first and second surfaces 216*a*, 216*b* are positioned at an angle relative to each other that is greater than 90°. As shown in the embodiment of FIG. 10, the first end portion 216 includes a first shoulder 219*a* and a first end extension 220 that extends between the first end 212 of the axial extension 210 and the first shoulder 219*a*. In the embodiment shown, first end portion 216 has a diameter D1 and the first end extension 220 has a diameter D2, which is less than D1. A second shoulder 219*b* is located at an opposing end of the first end portion 216 from the first end 212 of the axial extension 210.

The central portion 218 extends between the second shoulder 219*b* and an annular groove 224. The annular groove 224 may be dimensioned to retain a spacer 58 or a retaining ring 38. The second end portion 217 extends from the annular groove 224 to the second end 214 of the axial extension 210. Still referring to FIG. 10, the second end portion 217 includes a third shoulder 219*c* and a second end extension 222 that extends between the second end 214 of the axial extension 210 and the third shoulder 219*c*. In the embodiment shown, the second end portion 217 has a diameter D3 and the second end extension 222 has a diameter D4, which is less than D3. The first, second and third shoulders 219*a*, 219*b*, 219*c* may be formed as a single unit with the axial extension 210 or may be a separate component that is fixedly coupled to the axial extension 210. In an embodiment, at least one of diameters of the first end portion D1, D2, the diameters of the second end portion D3, D4, and a diameter of the central portion 218 are of a same size. Other embodiments of the axial extension may include fewer or more shoulders or annular grooves.

Figure 7:
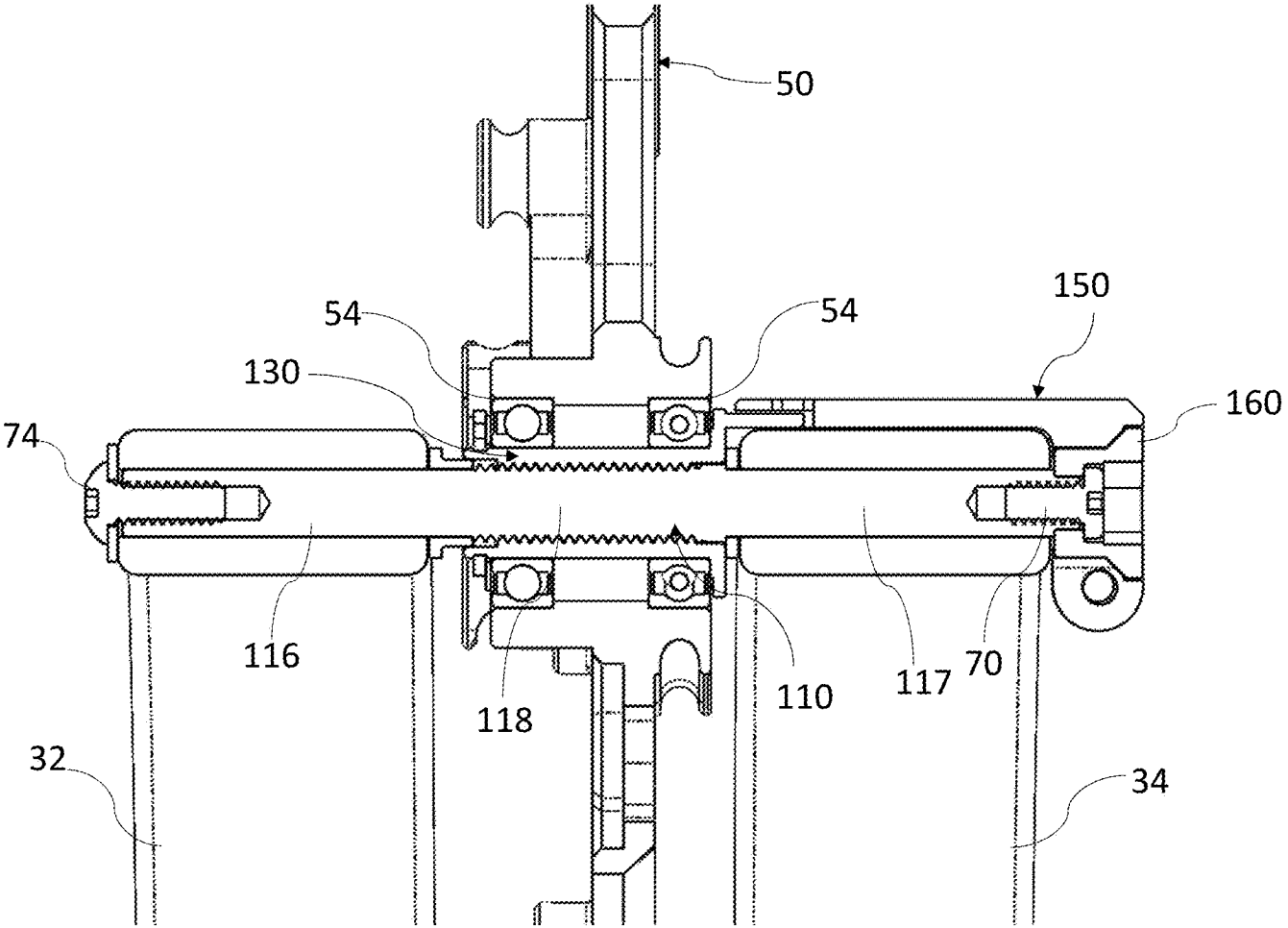
FIG. 7 illustrates a forward plan view of the assembly of FIG. 6.
Figure 11:
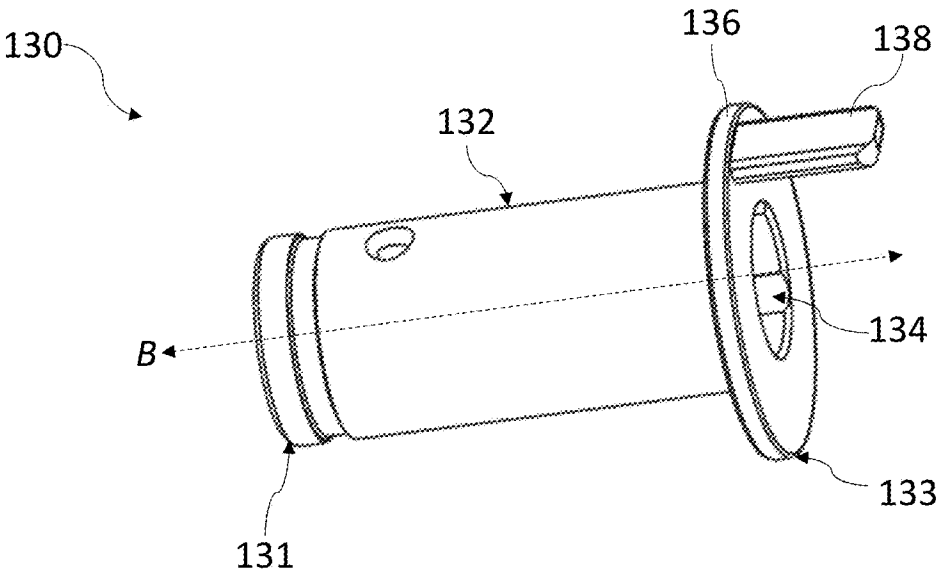
FIG. 11 illustrates a perspective view of an exemplary embodiment of a cam carrier of the cam adjuster in accordance with aspects of the present invention.

The cam adjustment assembly 100 further includes a cam support or cam carrier 130, as best shown in FIGS. 6, 7 and 11. The cam carrier 130 has a body 132 extending along a body axis B extending from a first open end 131 to a second open end 133. An inner cavity 134 or bore extends entirely through the body 132 between the first end 131 and the second end 133 of the cam carrier 130. The inner wall surrounding the inner cavity 134 includes a set of internal threads that are complementary to the exterior threads provided on the central portion 118 of the axial extension 110. In this manner, the cam carrier 130 can be threaded onto the central portion 118 of the axial extension 110. As best shown in FIG. 11, the second end 133 of the body 132 is defined by a radial flange 136. A positioning member 138 extends from the radial flange 136 along an axis parallel to the body axis B. In the embodiment shown in FIG. 6, the cam carrier 130 may also support one or more retaining rings 38 and spacers 39.

Figure 12:
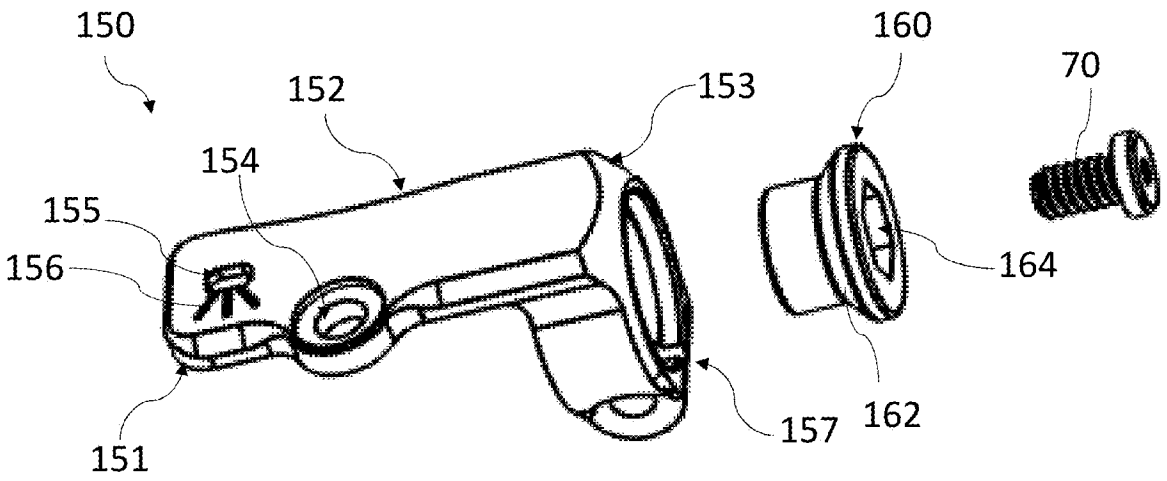
FIG. 12 illustrates an exploded assembly view of an exemplary embodiment of a securing member, a plug and a fastener in accordance with aspects of the present invention.
Figure 13:
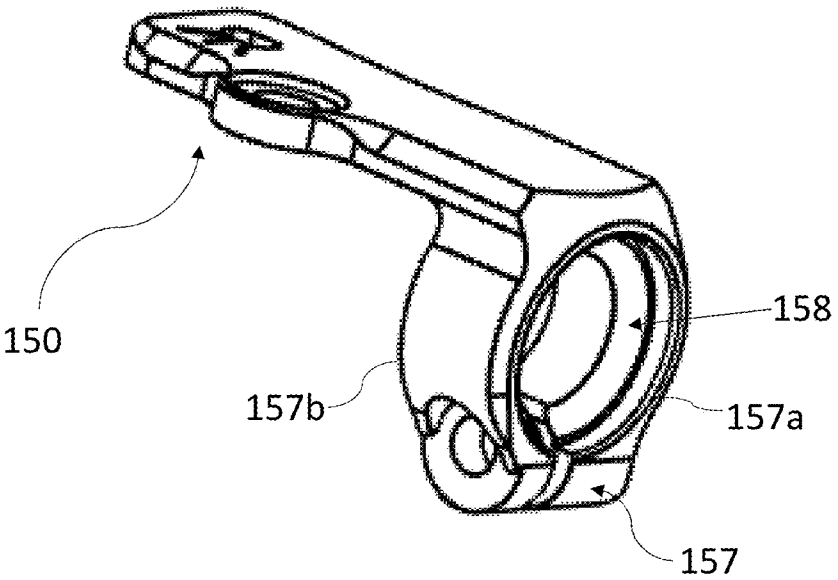
FIG. 13 illustrates a sided perspective view of the securing member of FIG. 12.
Figure 14:
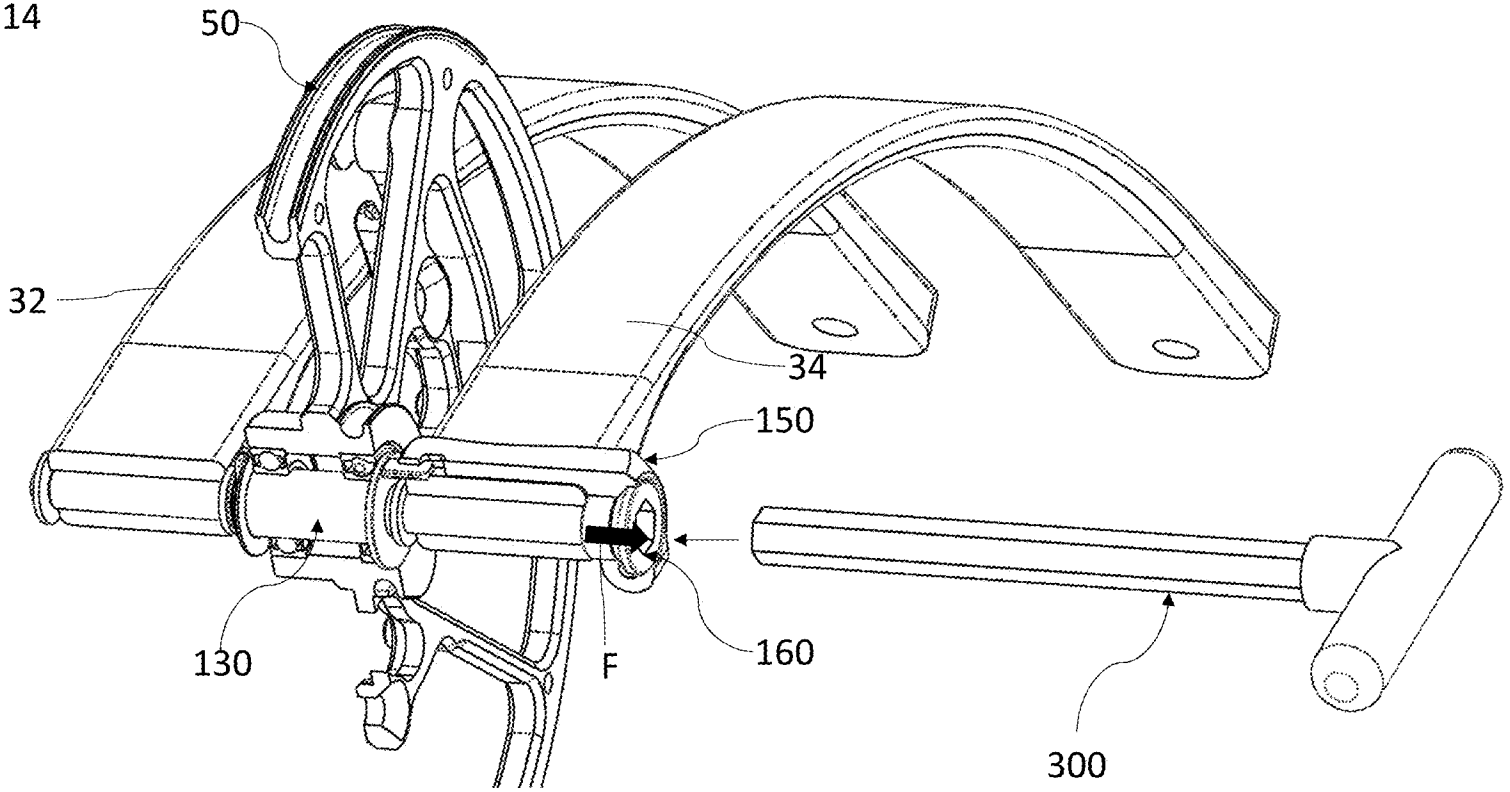
FIG. 14 illustrates the assembly of FIG. 5, further depicting use of a tool to rotate the plug as part of a process to adjust the cam.
Figure 15:
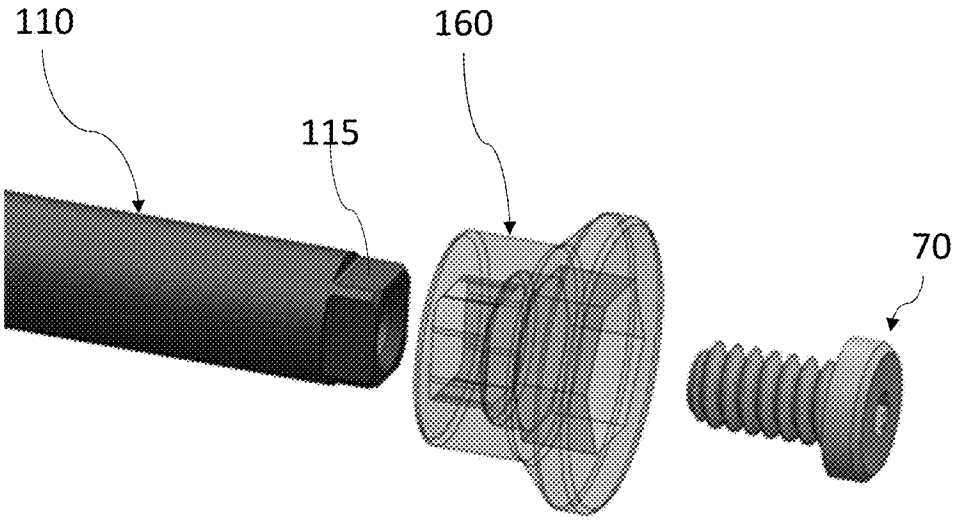
FIG. 15 illustrates an exploded view of an embodiment of the plug, fastener and the axial extension.
Figure 16:
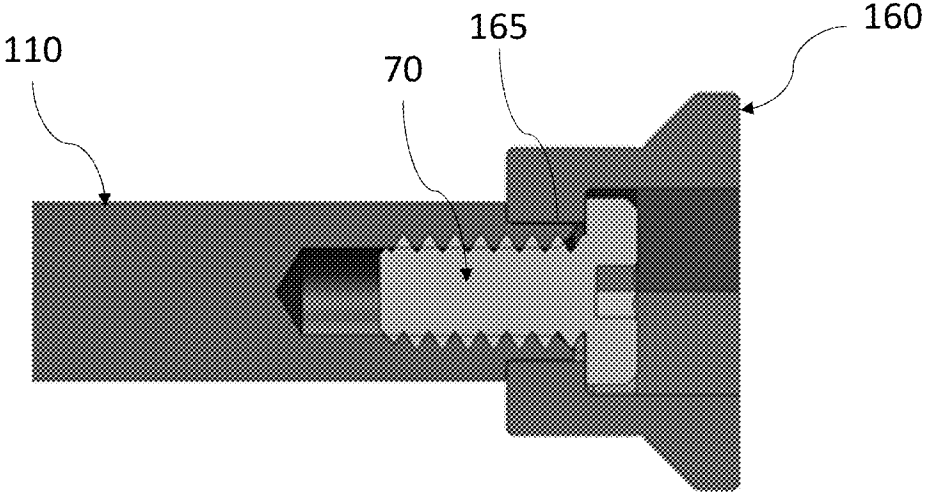
FIG. 16 illustrates a longitudinal sectional view of the plug coupled to the axial extension via the fastener and in accordance with aspects of the present invention.
Figure 23:
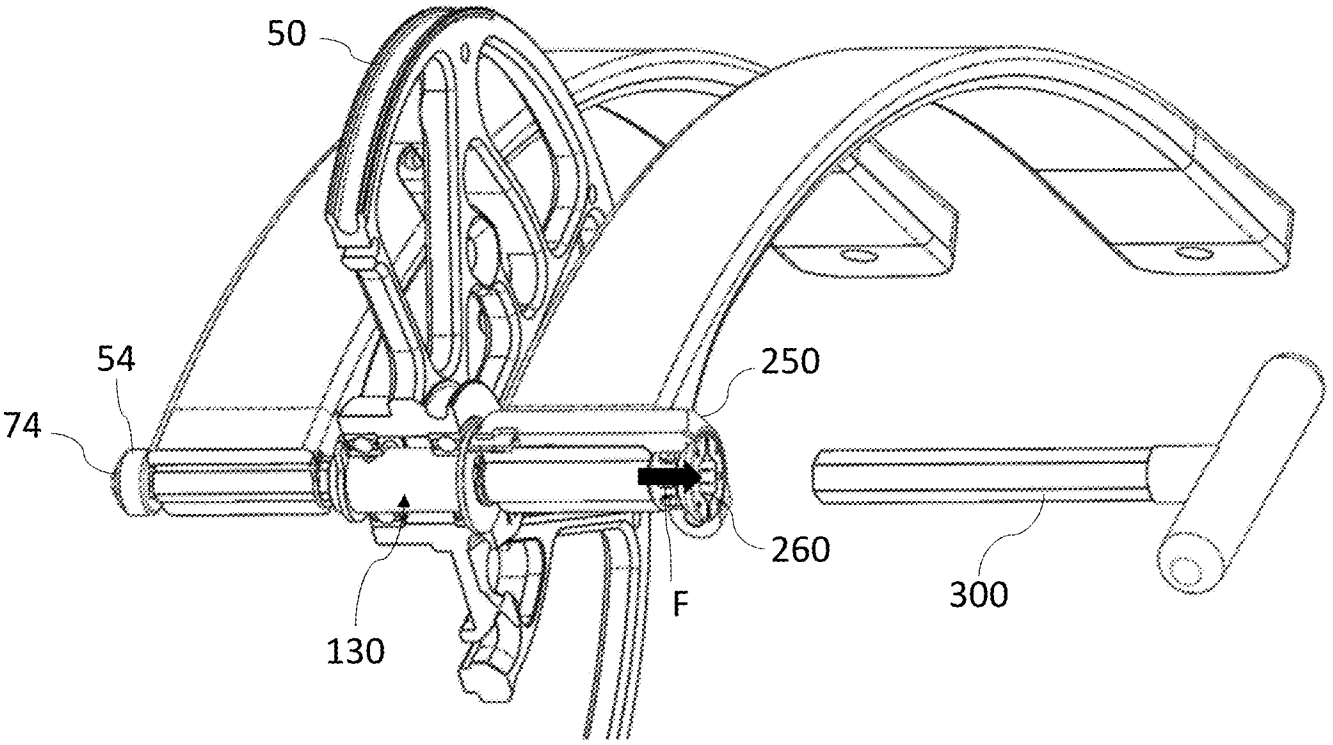
FIG. 23 illustrates the assembly of FIG. 8, further depicting use of a tool to rotate the plug as part of a process to adjust the cam.

As shown in FIGS. 4, 12 and 13, the cam adjustment assembly 100 further includes a securing member 150. The securing member 150 includes a securing member body 152 having a first end 151 including an elongated section that terminates at an opposing second end 153 having a ring-like portion. The elongated portion of the securing member body 152 includes one or more transverse openings 154 dimensioned or otherwise sized to accept a fastener to enable the securing member 150 to be coupled to one of the first and second limb assembly portions 32, 34. The elongated portion of the securing member body 152 further defines an elongated aperture 155 positioned towards the first end 151 of the securing member body 152. According to this embodiment, a plurality of position markings 156 are provided on at least one side of the elongated aperture 155. As shown, the plurality of position markings 156 are formed with the securing member body 152 as a single unit. In other embodiments, the plurality of position markings 156 can be separately applied to the elongated portion of the securing member body 152. The ring-shaped portion provided at the second end 153 of the securing member body 152 includes a clamp 157 having respective first and second clamp portions 157*a* and 157*b*, as best shown in FIG. 13. The first and second clamp portions 157*a*, 157*b* further define an inner tapered surface 158. As shown in FIG. 10, the clamp 157 radially secures a plug 160, the latter including an outer tapered surface 162 that is complementary to the inner tapered surface 158 of the first and second clamp portions 157*a*, 157*b*. The plug 160 further includes a central bore 164 that traverses a length of the plug 160 and is dimensioned to at least partially accept a fastener 70, such as a screw, in order to couple the plug 160 to the second end 114 of the axial extension 110. In an embodiment, the second end 114 of the axial extension 110 includes one or more mating surfaces 115 (see FIG. 15) that engage one or more complementary mating surfaces 165 (see FIG. 16) from the plug 160. When the plug 160 is coupled to the axial extension 110, the two components move in unison, or otherwise act as a single component. At one end of the plug 160, the central bore 164 is defined by a plurality of angular sides that are dimensioned to accept a tool 300 (see FIGS. 14 and 23), such as a hex wrench. The tool 300 is used to rotate the plug 160 and the axial extension 110 in a clockwise or counter-clockwise direction without loosening or uncoupling the plug 160 from the axial extension 110.

Figure 8:
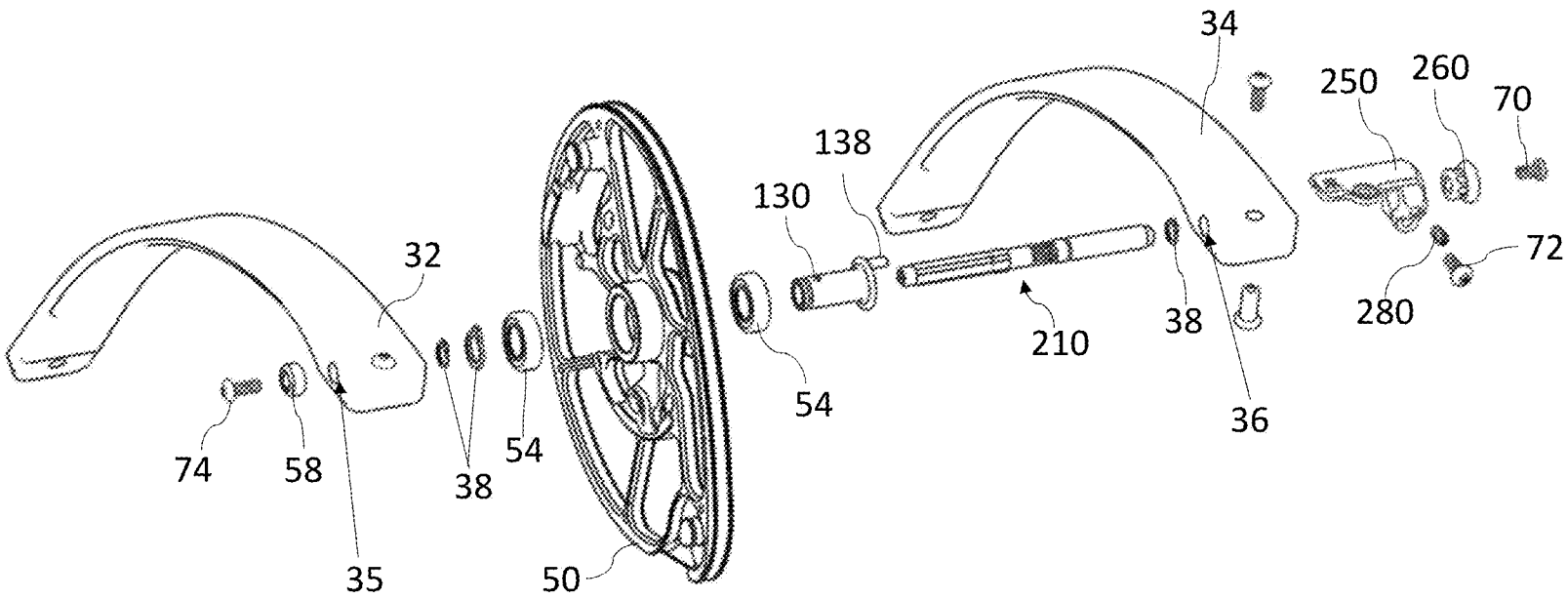
FIG. 8 illustrates an exploded assembly view of another embodiment of the limb assembly and cam.

Assembly and operation of the cam adjustment assembly 100 will now be explained with general reference to FIGS. 4-7 and FIGS. 14 and 23. The second end 32*b* of the first limb assembly portion 32 defines a bore 35 dimensioned to partially accept the first end portion 116 of the axial extension 110. Similarly, the second limb assembly portion 34 defines a bore 36 in which the bores 35, 36 are transverse to the major dimension of the first and second limb assembly portions and dimensioned to partially accept the second end portion 117 of the axial extension 110 such that the axial extension 110 extends between the first and second limb assembly portions 32, 34. The cam carrier 130 is threaded onto the central portion 118 of the axial extension 110. The axial extension 110 and cam carrier 130 are inserted through a center opening formed in the first cam 50 such that the first cam 50 is positioned on and supported by the cam carrier 130. Accordingly, the cam 50 does not contact or otherwise engage the axial extension 110. The first cam 50 may include one or more bearings 54 that enable rotation of the first cam 50 relative to the cam carrier 130. As described, the one or more bearings 54 are not part of the cam adjustment assembly 100. The positioning member 138 of the cam carrier 130 is inserted into the securing member 150, which is shown as being coupled to the first limb assembly portion 32. A portion of the positioning member 138 is visible through the elongated aperture 155. In an embodiment, the positioning member 138 may include one or more position markings that are visible through the elongated aperture 155. One or more bushings 56 and spacers 58 may be positioned along the axial extension 110. As shown in FIG. 4, a bushing 56 is positioned in the first end portion 112 of the axial extension and a spacer 58 is positioned on the second end portion 114 of the axial extension. In other embodiments, the position and the number of retaining rings 38, bushings 56 and spacers 58 may be varied, for example, as shown in FIG. 8. In this latter embodiment, no bushings 56 are used and a spacer 58 is positioned to engage the fastener 74.

The first end 112 of the axial extension 110 is secured within the bore 35 of the first limb assembly portion 32 using a fastener 74 at least partially inserted through the first limb assembly portion 32 and into the cavity 112*a* at the first end 112 of the axial extension 110. At least part of the second end portion 117 of the axial extension 110 is inserted through the bore 36 of the second limb assembly portion 34. The plug 160 is inserted into the clamp 157 as shown in FIG. 6 and a fastener 70 is used to secure the plug 160 to the second end 114 of the axial extension 110 via the second end cavity 114*a*. The plug 160 is rotated on a first direction using the tool 300 (see FIGS. 14 and 23). The clamp 157 is then secured using a clamping fastener 72 to draw the first clamp portion 157*a* and the second clamp portion 157*b* together to secure and tension the second end 114 of the axial extension 110 between the plug 160/fastener 70 and the spacer 58. With the clamp 157 secured, the cam adjustment assembly 100 is in a locked state such that the first cam 50 is capable of rotating relative to the cam carrier 130 but is inhibited from being moved in a direction along its axis of rotation. In the locked state, the axial extension 110 is inhibited from rotating relative to the cam carrier 130 due to the positioning member 138 being held in place by the securing member 150 and the tension created by the clamp 157.

In order to move the cam adjustment assembly 100 to an unlocked state, the clamp fastener 72, and the fastener 74 are removed (or backed out) to release the tension applied to the axial extension 110. In an embodiment, once the fastener is in place, removing (or backing out) or securing the clamp fastener 72 is all that is required to move the cam adjustment assembly 100 between the unlocked and locked states, respectively. For example, removing (or backing out) the clamp fastener 72 results in a separation of the first and second clamp portions 157*a*, 157*b*, which releases tension from the second end 114 of the axial extension 110. While in the unlocked state, the components of the cam adjustment assembly 100 are no longer under compression such that the axial extension 110 is able to freely rotate using the tool 300 in order to rotate the plug 160. Rotating the plug 160 with the tool 300 acts to rotate the axial extension 110 relative to the cam carrier 130, the one or more bushings 56, the spacer 58, and the first and second limb assembly portions 32, 34. For example, rotation of the axial extension 110 in a first direction relative to the cam carrier 130 results in the cam carrier 130 moving along the axial extension 110 in a first direction towards the first limb assembly portion 32. Conversely, rotation of the axial extension 110 in a second direction relative to the cam carrier 130 results in the cam carrier 130 moving along the axial extension 110 in a direction towards the second limb assembly portion 34. Movement of the cam carrier 130 results in a lateral displacement of the first cam 50 and the bearings 54 between the first and second limb assembly portions 32, 34, which in turn laterally displaces the bowstring plane. As the cam carrier 130 moves along the axial extension 110, the positioning member 138 is moved within the elongated aperture 155 of the securing member 150. In this manner, the position of the cam carrier 130 (and the first cam 50) can be finely adjusted to a particular positon using the plurality of position markings 156. In the case of a second axle assembly being used in conjunction with the second cam 60, the position members of each cam carrier 130 can be used to compare the lateral adjustment of the first cam 50 to that of the second cam 60. The interaction between the positioning member 138 and the elongated aperture 155 also inhibits rotation of the cam carrier 130 as the axial extension 110 is rotated.

Once the first cam 50 is laterally positioned as desired, the clamp fastener 72 and the fastener 74 are replaced and tightened to tension both ends of the axial extension 110 to define the locked state. As previously described, the tightening of the clamp fastener 72 acts to compress components of the cam adjustment assembly 100 coaxially along the axis of rotation of the first cam 50. More specifically and in the locked state, the inner tapered surface 158 of the clamp 157 surrounds and contacts the outer tapered surface 162 of the plug 160 to create a biasing force F (see FIGS. 14 and 23) along the axial extension 110 to inhibit rotation of the plug 160 relative to the clamp 157. Tightening the fastener 74 acts to generate an axial compression force towards the first end 112 of the axial extension 110. Together, the clamp fastener 72 and the fastener 74 act to compress and lock components of the cam adjustment assembly 100 in place.

Figure 20:
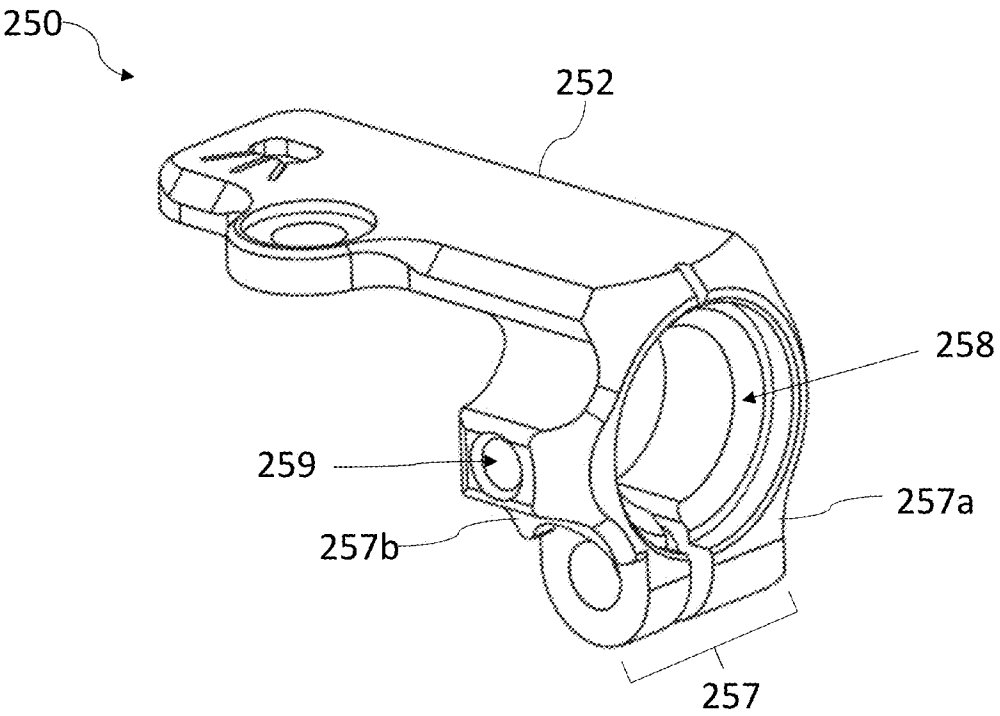
FIG. 20 illustrates a sided perspective view of the embodiment of the securing member of FIG. 19.
Figure 21:
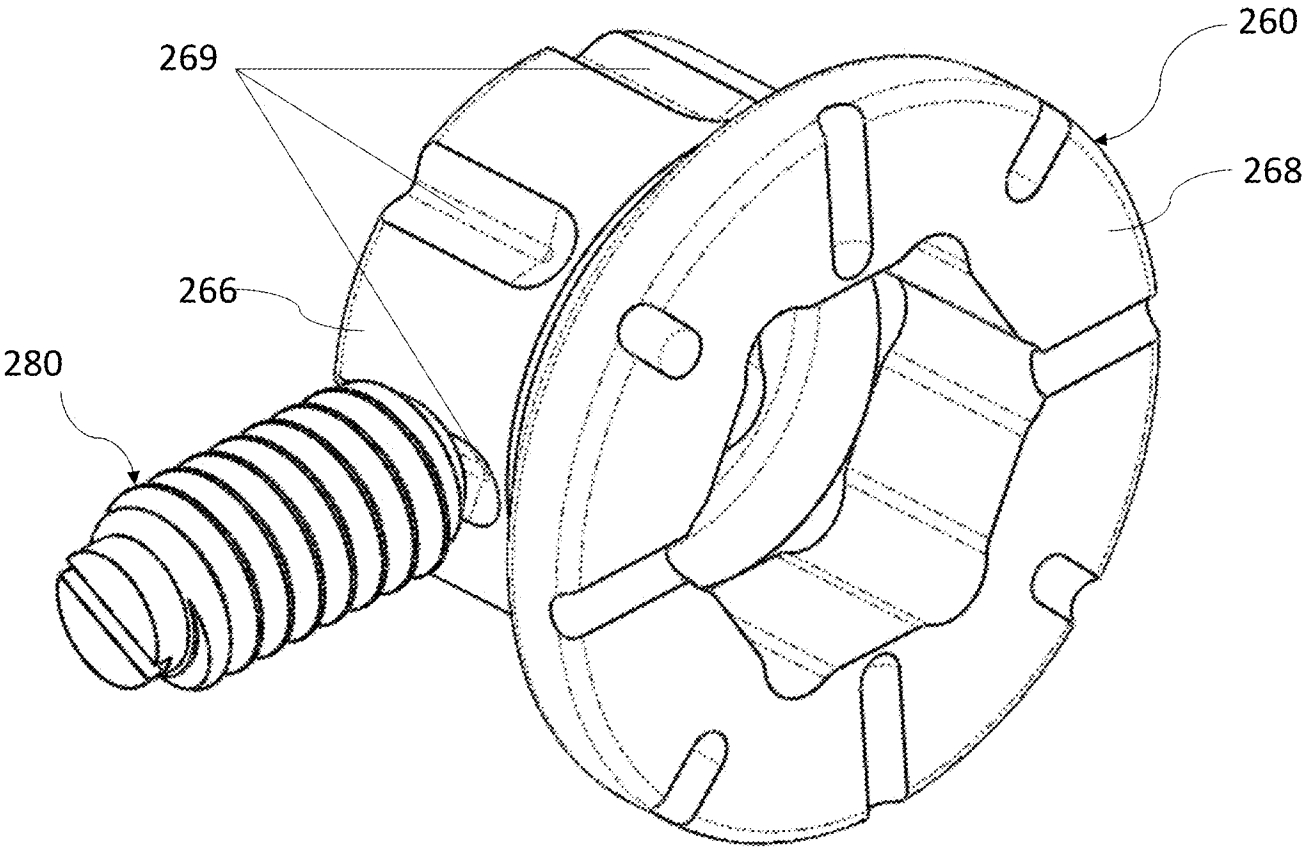
FIG. 21 illustrates a front perspective view of an exemplary embodiment of the plug with a micro-adjustment element in accordance with aspects of the present invention.

As shown in FIGS. 17-20, another embodiment of the securing member 250 and plug 260 are shown. In this specific embodiment, the securing member 250 is defined by a securing member body 252 having a first end 251 including an elongated section that terminates at an opposing second end 253, the latter having a ring-like portion. The elongated portion of the securing member body 252 includes one or more transverse openings 254 dimensioned or otherwise sized to accept a fastener to enable the securing member 250 to be coupled to one of the first and second limb assembly portions 32, 34. The elongated portion of the securing member body 252 further defines an elongated aperture 255 positioned towards the first end 251 of the securing member body 252. Similar to other embodiments, a plurality of position markings 256 are provided on at least one side of the elongated aperture 255. As shown, the plurality of position markings 256 are formed with the securing member body 252 as a single unit. In other embodiments, the plurality of position markings 256 can be separately applied to the elongated portion of the securing member body 252. The ring-shaped portion provided at the second end 253 of the securing member body 252 includes a clamp 257 having respective first and second clamp portions 257*a* and 257*b*, as best shown in FIG. 20. The first and second clamp portions 257*a*, 257*b* further define an inner tapered surface 258. This embodiment of the securing member 250 further defines a bore or opening 259 on one of the first and second clamp portions 257*a*, 257*b*.

Figure 17:
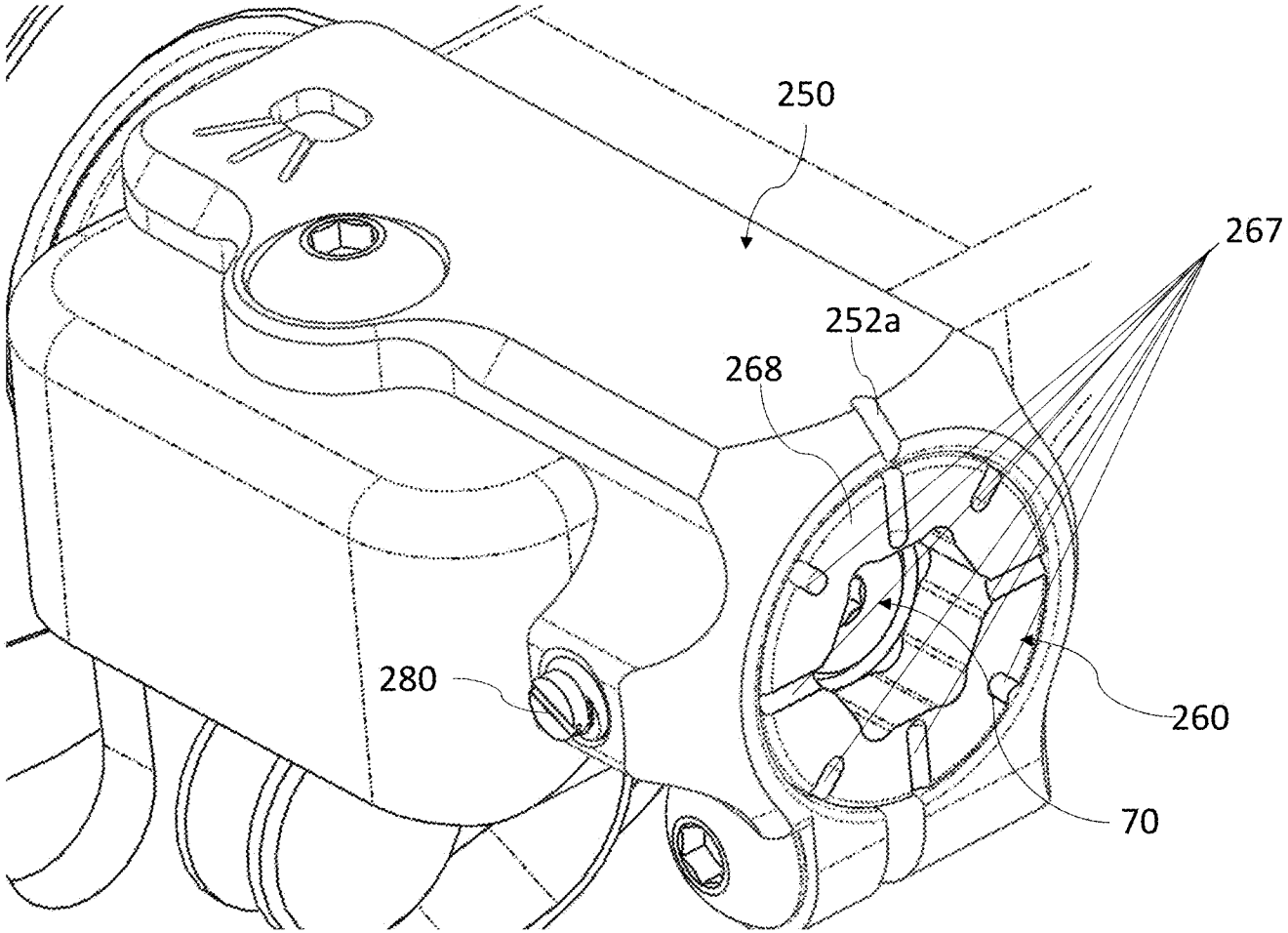
FIG. 17 illustrates an enlarged perspective view of another exemplary embodiment of the securing member and the plug, in accordance with aspects of the present invention.
Figure 18:
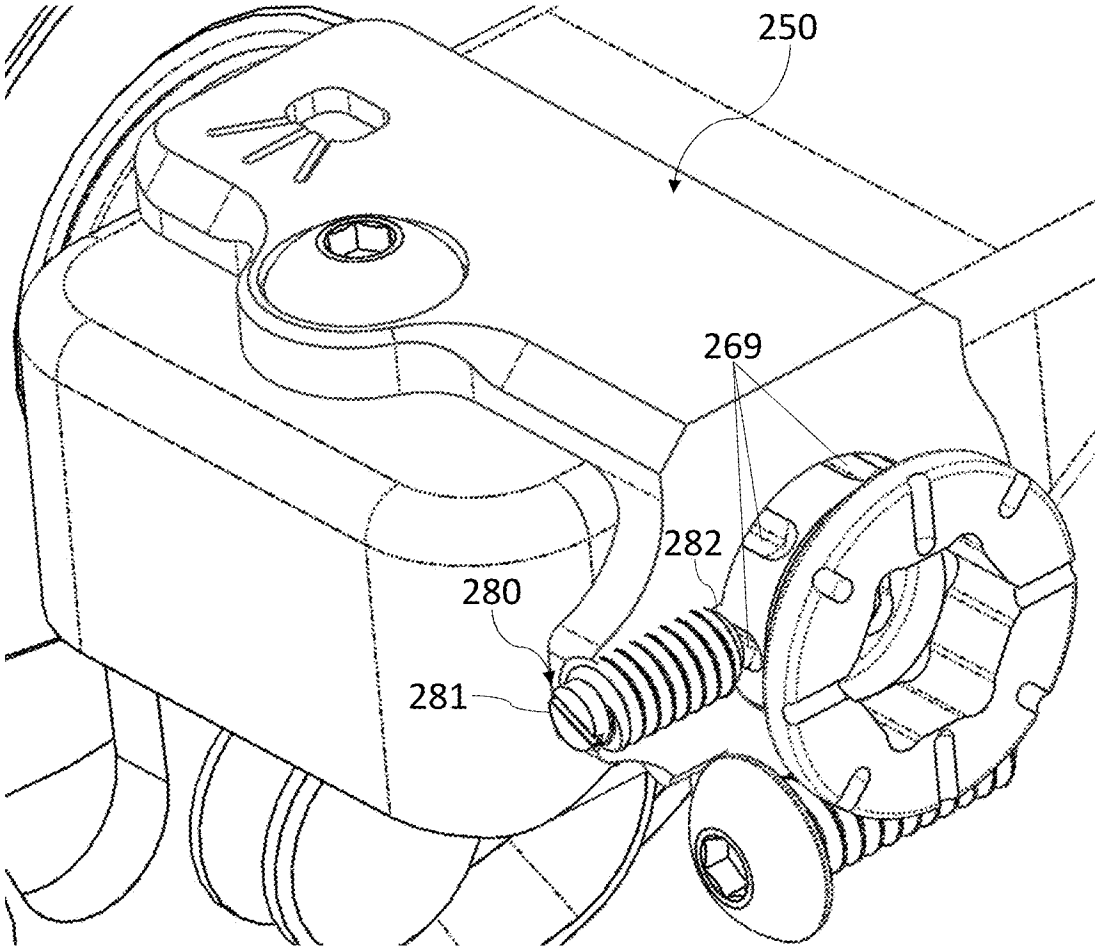
FIG. 18 illustrates the embodiment of FIG. 17 with a portion of the securing member removed.
Figure 19:
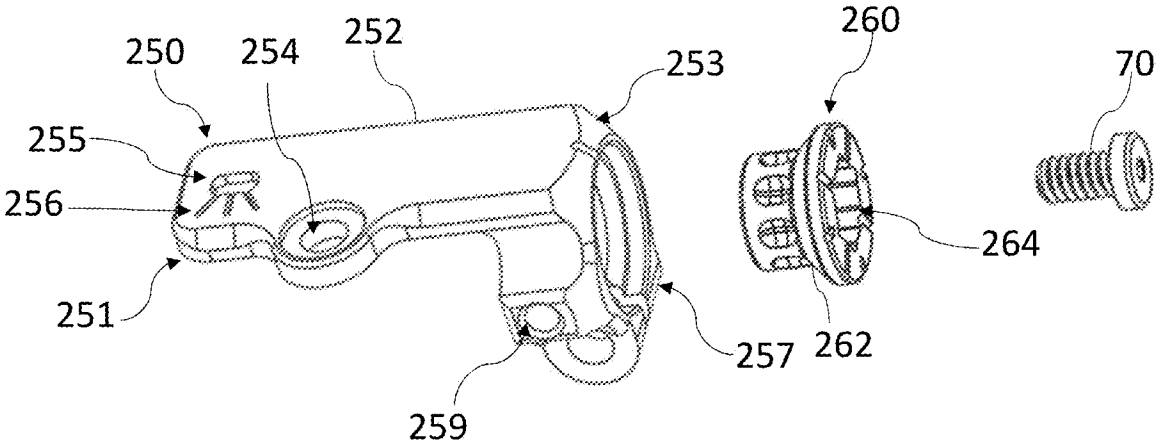
FIG. 19 illustrates an exploded assembly view of another exemplary embodiment of a securing member, a plug and a fastener in accordance with aspects of the present invention.
Figure 22:
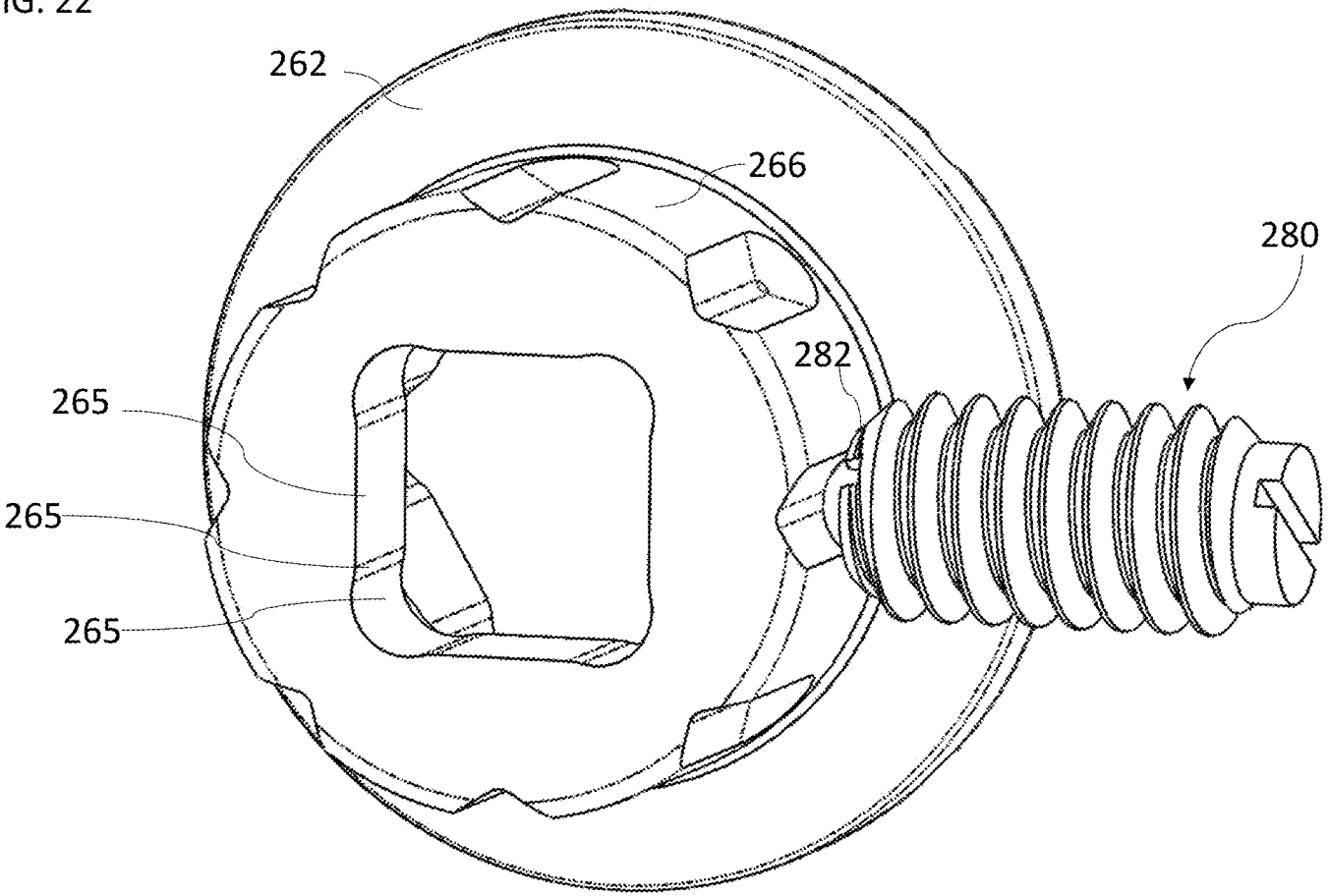
FIG. 22 illustrates a rear perspective view of the plug and micro-adjustment element of FIG. 21.
Figure 24:
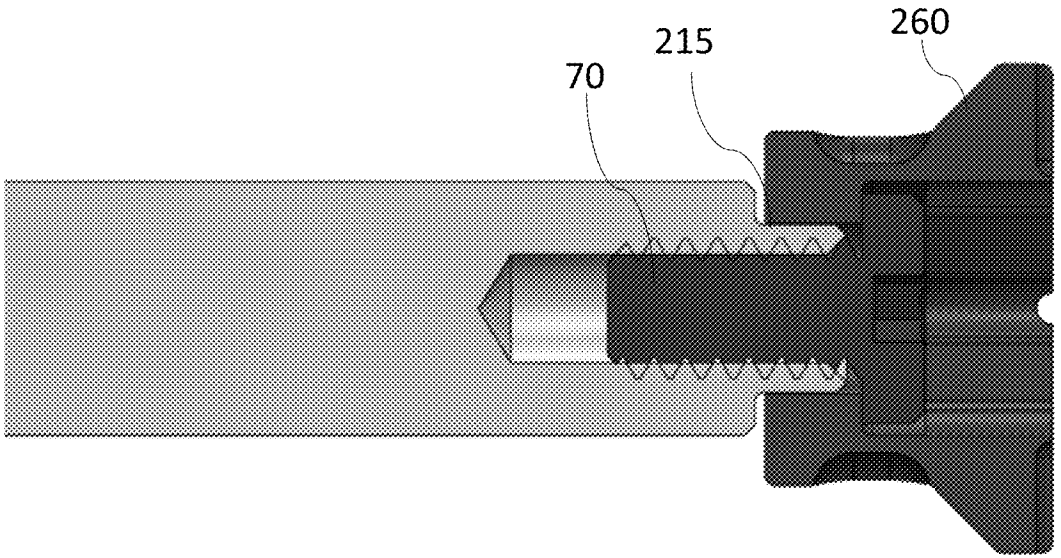
FIG. 24 illustrates a longitudinal sectional view of the embodiment of the plug according to FIG. 23 coupled to the axial extension via the fastener and in accordance with aspects of the present invention.

As shown in FIGS. 17 and 18, the clamp 257 radially secures a plug 260, the latter including an outer tapered surface 262 that is complementary to the inner tapered surface 258 of the first and second clamp portions 257*a*, 257*b*. The plug 260 further includes a central bore 264 that traverses a length of the plug 260 and is dimensioned to at least partially accept a fastener 70, such as a screw, in order to couple the plug 260 to the second end 214 of the axial extension 210. The second end extension 222 of the axial extension 210 includes one or more mating surfaces 215 (see FIG. 24) that engage one or more corresponding or complementary mating surfaces 265 (see FIG. 22) from the plug 260. When the plug 260 is coupled to the axial extension 210, the two components move in unison, or otherwise act as a single component. At one end of the plug 260, the central bore 264 is defined by a plurality of angular sides that are dimensioned to accept a tool 300 (see FIG. 23), such as a hex wrench. The tool 300 is used to rotate the plug 260 and the axial extension 210 in a clockwise or counterclockwise direction without loosening or uncoupling the plug 260 from the axial extension 210.

In this specific embodiment, the plug 260 includes a plurality of indicators 267 that are disposed or defined around a face 268 of the plug 260. An indicator 267 of the plug 260 can be aligned with a corresponding position marking 252*a* of the securing element 250 to enable a more precise adjustment of the cam 50 along the axial extension 210. A micro adjuster 280 or a set screw may further be provided. The micro adjuster 280 is preferably configured to be at least partially accepted by the opening 259 of the securing member 250 and cooperate with the plug 260 to enable an incremental rotation of the plug 260, preferably with an additional auditory indication, such as a click. Turning to FIGS. 17, 18, 21 and 22, the plug 260 further includes a plurality of positioning elements 269 defined around an outer side 266 of the plug 260. As shown, the positioning elements 269 are detents or divots defined in the outer side 266 of the plug 260.

The micro adjuster 280 is structured to be at least partially inserted into a bore defined in the securing member body 252, wherein the micro adjuster 280 is defined by a unitary member that extends between a first end 281 and a second end 282. The first end 281 of the micro adjuster 280 is configured to interact with a tool or the fingers of a user in order to rotate the micro adjuster 280 within the bore and relative to the securing element body 252. The second end 282 of the micro adjuster 280 is structured to cooperate with the positioning elements 269 of the plug 260. As shown, the micro adjuster 280 may be rotated such that it engages the outer side 266 of the plug 260. As the plug 260 is rotated, the user is provided with a tactile indication or "feel" when the second end 282 of the micro adjuster 280 moves over a positioning element 269. The user may then rotate the micro adjuster 280 relative to the securing member body 252 in order to advance the micro adjuster 280 towards the outer side 266 of the plug 260 so that the second end 282 of the micro adjuster 280 engages with the positioning element 269 to lock the plug 260 in the corresponding position.

In another embodiment, the micro adjuster 280 may cooperate with a biasing element (not shown) such that rotation of the micro adjuster 280 over a positioning element 269 causes the biasing element to relax and move the micro adjuster 280 towards the outer side 266 of the plug 260. In this manner, the second end 282 of the micro adjuster 280 will engage the positioning element 269 resulting in an auditory "clicking" noise, which indicates to the user that the plug 260 is secured in its current positon. Further rotation of the micro adjuster 280 will cause the second end 282 of the micro adjuster 280 to disengage from the positioning element 269, which also causes the biasing element to be compressed. As the micro adjuster 280 is rotated, the second end 282 rides along the outer side 266 of the plug 260 until the next positioning element 269 is reached, which again causes the biasing element to relax and move the micro adjuster 280 towards the outer side 266 of the plug 260 to engage the positioning element 269, thereby causing another auditory "click" sound to be heard by the user. Accordingly, the positioning elements 269 may be spaced apart from each other along the outer side 266 at any desired increment.

In still another embodiment, the micro adjuster 280 is a locking element, which is structured to engage with the positioning elements 269 of the plug 260 to inhibit rotation of the plug 260. In this embodiment, the micro adjuster 280 locks the rotational positon of the plug 260 relative to the securing member 250. When the micro adjuster 280 is disengaged from the positioning elements 269, the plug 260 is capable of being rotated relative to the securing member 250 in order to adjust the position of the cam carrier 130 along the axial extension 110, 210.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female connection) configured to receive the second element (functioning as a male connection). In either such embodiment, the first and second elements are configured to mate with, fit with or otherwise interlock with each other.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

PARTS LIST FOR FIGS. 1-24

10 archery bow
20 body

30 first limb assembly
32 first limb assembly portion
32*a* first end, first limb assembly portion
32*b* second end, first limb assembly portion
34 second limb assembly portion
35 bore(s)
36 bore(s)
38 retaining ring(s)
39 spacer(s)
40 second limb assembly
50 first rotor or cam
54 one or more bearings
56 bushing
58 spacer
60 second rotor or cam
65 power cord
66 power cord
68 bow string
72 clamping fastener
74 fastener
80 arrow
100 cam adjustment assembly
110 axial extension
112 first end, axial extension
112*a* first end cavity
114 second end, axial extension
114*a* second end cavity
115 mating surfaces, axial extension
116 first end portion, axial extension
117 second end portion, axial extension
118 central or intermediate portion, axial extension
119 shoulder
130 cam carrier
131 first open end, cam carrier body
132 cam carrier body
133 second open end, cam carrier body
134 inner cavity
136 radial flange
138 positioning member
150 securing member
151 first end, securing member body
152 securing member body
153 second end, securing member body
154 transverse openings
155 elongated aperture
156 position markings
157 clamp
157*a* first clamp portion
157*b* second clamp portion
158 inner tapered surface, clamp
159 position marking
160 plug
162 outer tapered surface, plug
164 central bore
165 complementary mating surfaces, plug
166 outer side, plug
167 indicators, plug
168 face, plug
210 axial extension
211 exterior
212 first end
212*a* cavity
214 second end
214*a* cavity
215 mating surfaces
216 first end portion
216*a* first surface
216*b* second surface
217 second end portion
218 central or intermediate portion
218*a* set of external threads
219*a* first shoulder
219*b* second shoulder
219*c* third shoulder
220 first end extension
222 second end extension
224 annular groove
250 securing member
251 first end, securing member body
252 securing member body
252*a* position markings, securing element
253 second end, securing member body
254 transverse openings
255 elongated aperture
256 position markings
257 clamp
257*a* first clamp portion
257*b* second clamp portion
258 inner tapered surface, clamp
259 bore or opening
260 plug
262 outer tapered surface, plug
264 central bore
265 complementary mating surfaces, plug
266 outer side, plug
267 indicators, plug
268 face, plug
269 positioning element
280 micro adjuster
281 first end, micro adjuster
282 second end, micro adjuster
300 tool
T target
B body axis Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The invention claimed is:

1. An archery bow comprising:

a limb assembly comprising at least one limb portion;

a cam adjustment assembly configured to couple to the at least one limb assembly, wherein the cam adjustment assembly comprises, an axle extension extending along an axis and configured to traverse the at least one limb portion, the axle extension including a first end, an opposing second end and a central portion, wherein the central portion includes a set of threads, a cam support configured to engage the central portion of the axle extension and move along the axis of the axle extension, a securing member structured to partially accept the axle extension and be moved between a locked and an unlocked state;

a plug configured to rotatably engage the securing member and engage the second end of the axle extension; and a cam supported by the cam support and configured to rotate relative to the cam support, wherein in the unlocked state, the plug is enabled to rotate relative to the securing member and the axle extension is enabled to rotate freely relative to the cam support to move the cam support along the axis in order to displace the cam in a lateral direction with respect to the limb portion, and wherein in the locked state, the plug is inhibited from rotating relative to the securing member and the axle extension is inhibited from rotating relative to the cam support.

2. The archery bow of claim 1, wherein the securing member further includes a clamp comprising a first clamp portion and a second clamp portion.

3. The archery bow of claim 2, wherein the first clamp portion and the second clamp portion are structured to at least partially surround the plug and, in the locked state, exert a biasing force in a direction along the axis to inhibit rotation of the plug relative to the securing member and the axle extension.

4. The archery bow of claim 1, wherein the cam support further comprises a positioning member structured to engage the securing member, and wherein the positioning member includes one or more position markings indicating a lateral position of the cam support.

5. The archery bow of claim 4, wherein the securing member defines an aperture, wherein the one or more position markings of the positioning member are visible through the aperture and wherein, in the locked state, the positioning member inhibits rotation of the cam support.

6. The archery bow of claim 1, wherein the securing member further comprises a micro adjuster structured to engage the plug, wherein, in the unlocked state, the micro adjuster is structured to enable a micro adjustment of a rotational position of the plug relative to the securing member.

7. The archery bow of claim 6, wherein the plug comprises a plurality of positioning elements, wherein the micro adjuster is structured to engage one of the plurality of positioning elements to secure the plug in a corresponding rotational position, and wherein the micro adjuster is structured to produce an auditory indication when the plug is secured in the corresponding rotational position.

8. An archery cam adjustment assembly for an archery bow, comprising:

an axle extending along an axis from a first end to an opposing second end and structured to traverse a limb of an archery bow, where the axle further includes a central portion having a plurality of threads;

a cam support structured to support a cam and configured to engage the central portion of the axle;

a securing member configured to be moved between a locked and an unlocked state; and a plug configured to rotatably engage the securing member and engage the second end of the axle, wherein in the unlocked state, the plug is enabled to rotate relative to the securing member and the axle is enabled to rotate freely relative to the cam support to move the cam support along the axis in order to displace the cam in a lateral direction with respect to the limb, and wherein in the locked state, the plug is inhibited from rotating relative to the securing member and the axle is inhibited from rotating relative to the cam support.

9. The archery cam adjustment assembly of claim 8, wherein the securing member further includes a clamp comprising a first clamp portion and a second clamp portion.

10. The archery cam adjustment assembly of claim 9, wherein the first clamp portion and the second clamp portion are structures to at least partially surround the plug and, in the locked state, exert a biasing force in a direction along the axis to inhibit rotation of the plug relative to the securing member and the axle.

11. The archery cam adjustment assembly of claim 8, wherein the cam support further comprises a positioning member configured to engage the securing member, wherein the positioning member includes one or more position markings indicating a lateral position of the cam support.

12. The archery cam adjustment assembly of claim 11, wherein the securing member defines an aperture, wherein the one or more position markings of the positioning member are visible through the aperture and wherein, in the locked state, the positioning member inhibits rotation of the cam support.

13. The archery cam adjustment assembly of claim 8, wherein the securing member further comprises a micro adjuster configured to engage the plug, wherein, in the unlocked state, the micro adjuster is configured to enable a micro adjustment of a rotation of the plug relative to the securing member.

14. The archery cam adjustment assembly of claim 13, wherein the plug comprises a plurality of positioning elements, wherein the micro adjuster is structured to engage one of the plurality of positioning elements to secure the plug in a corresponding rotational position, wherein the micro adjuster is structured to produce an auditory indication when the plug is secured in the corresponding rotational position.

15. A method of manufacturing an archery cam adjustment assembly, comprising:

structuring an axle extension to extend along an axis from a first end to an opposing second end and to traverse a limb of an archery bow, structuring the axle extension to comprise a central portion defining a plurality of threads;

structuring a cam support to engage the central portion of the axle extension and to support a cam of an archery bow;

structuring a securing member to define a bore and to be moved between a locked and an unlocked state; and structuring a plug to be at least partially accepted by the bore and to engage an end of the axle extension, wherein in the unlocked state, the axle extension is enabled to rotate freely relative to the cam support to move the cam support along the axis and displace the cam in a lateral direction with respect to the limb, and wherein in the locked state, the axle extension is inhibited from rotating relative to the cam support and the cam support is inhibited from moving along the axis.

16. The method of claim 15, further comprising structuring the securing member to include a clamp comprising a first clamp portion and a second clamp portion.

17. The method of claim 16, further comprising:

structuring the first clamp portion and the second clamp portion to at least partially surround the plug; and exerting a biasing force in a direction along the axis when in the locked state, wherein the biasing force acts to inhibit rotation of the plug relative to the securing member and the axle extension.

18. The method of claim 15, further comprising structuring the cam support to include a positioning member structured to engage the securing member and to include one or more position markings.

19. The method of claim 18, further comprising:

structuring the securing member to define an aperture, wherein the one or more position markings of the positioning member are visible through the aperture and indicate a lateral position of the cam support; and structuring the positioning member to inhibit rotation of the cam support when in the locked state.

20. The method of claim 18, further comprising:

structuring the securing member to at least partially accept a micro adjuster;

structuring the plug to include a plurality of positioning elements;

structuring the micro adjuster to engage on of the plurality of positioning elements to secure the plug in a corresponding rotational position; and structuring the micro adjuster to produce an auditory indication when the plug is secured in the corresponding rotational position, wherein, in the unlocked state, structuring the micro adjuster to enable a micro rotation of the plug relative to the securing member.

* * * * *